US009565874B2

(12) United States Patent
Kaljura et al.

(10) Patent No.: US 9,565,874 B2
(45) Date of Patent: Feb. 14, 2017

(54) SMOKING ARTICLE AND METHOD OF MANUFACTURING A SMOKING ARTICLE

(75) Inventors: Karl Kaljura, London (GB); Kevin Blick, London (GB); David Paton, London (GB); Michael Simpson, Hong Kong (CN)

(73) Assignees: BRITISH AMERICAN TOBACCO (INVESTMENTS) LIMITED (GB); BRITISH AMERICAN TOBACCO JAPAN, LTD. (JP)

( * ) Notice: Subject to any disclaimer, the term of this patent is extended or adjusted under 35 U.S.C. 154(b) by 645 days.

(21) Appl. No.: 14/005,044

(22) PCT Filed: Mar. 9, 2012

(86) PCT No.: PCT/GB2012/050531

§ 371 (c)(1),
(2), (4) Date: Nov. 25, 2013

(87) PCT Pub. No.: WO2012/123723

PCT Pub. Date: Sep. 20, 2012

(65) Prior Publication Data

US 2014/0076338 A1 Mar. 20, 2014

(30) Foreign Application Priority Data

Mar. 14, 2011 (GB) ..... 1104232.2
Aug. 23, 2011 (GB) ..... 1114581.0

(51) Int. Cl.
*A24D 3/04* (2006.01)

(52) U.S. Cl.
CPC ..... *A24D 3/043* (2013.01); *A24D 3/041* (2013.01)

(58) Field of Classification Search
USPC ..... 131/281, 280, 360, 365, 361
See application file for complete search history.

(56) References Cited

U.S. PATENT DOCUMENTS 2,967,528 A 1/1961 Kelter
3,390,686 A * 7/1968 Irby, Jr. ..... A24D 3/061 131/337
3,738,375 A 6/1973 Doumas
3,810,477 A * 5/1974 Berger ..... A24D 3/04 131/340

(Continued)

FOREIGN PATENT DOCUMENTS

DE 3422776 C1 11/1985
DE 3516841 A1 11/1986

(Continued)

OTHER PUBLICATIONS

Written Opinion of IPEA, mailed Feb. 11, 2013, for International Patent Application No. PCT/GB2012/050531, filed Mar. 9, 2012.

(Continued)

*Primary Examiner* — Dennis Cordray
(74) *Attorney, Agent, or Firm* — Cantor Colburn LLP

(57) ABSTRACT

A smoking article comprises a first part and a second part movable relative to the first part. A control mechanism comprises a first control surface on one of the first part or second part; and a second control surface on the other of the first and second parts. The second control surface is configured to engage with the first control surface to control relative rotation between the first part and second part.

19 Claims, 10 Drawing Sheets

(56) References Cited

U.S. PATENT DOCUMENTS

| | | | | |
|---|---|---|---|---|
| 4,254,782 | A | 3/1981 | Ligeti | |
| 4,478,229 | A | 10/1984 | Luke | |
| 4,527,573 | A | 7/1985 | Hausermann | |
| 4,532,943 | A | 8/1985 | Nichols et al. | |
| 4,570,649 | A | 2/1986 | Nichols et al. | |
| 4,576,187 | A | 3/1986 | Deal | |
| 4,593,707 | A * | 6/1986 | Seidel | A24D 3/041 131/198.2 |
| 4,600,027 | A | 7/1986 | Houck et al. | |
| 4,649,945 | A | 3/1987 | Norman | |
| 4,658,838 | A | 4/1987 | Leonard | |
| 4,687,009 | A | 8/1987 | Nichols | |
| 4,699,158 | A | 10/1987 | Sprinkel, Jr. | |
| 4,700,725 | A | 10/1987 | Geiszler, Jr. | |
| 4,718,438 | A | 1/1988 | Deal | |
| 4,809,718 | A | 3/1989 | Deal | |
| 4,898,190 | A * | 2/1990 | Deal | A24D 3/041 131/198.2 |
| 5,105,838 | A | 4/1992 | White et al. | |
| 2013/0139836 | A1* | 6/2013 | Blick | A24D 3/041 131/331 |
| 2014/0238425 | A1* | 8/2014 | Kaljura | A24D 3/041 131/336 |

FOREIGN PATENT DOCUMENTS

| | | | |
|---|---|---|---|
| EP | 0100215 | A2 | 2/1984 |
| EP | 0105683 | A1 | 4/1984 |
| EP | 0107507 | A1 | 5/1984 |
| EP | 167863 | A1 | 1/1986 |
| EP | 0182055 | A1 | 5/1986 |
| EP | 0189980 | A1 | 8/1986 |
| EP | 0212879 | A1 | 3/1987 |
| EP | 0223494 | A1 | 5/1987 |
| EP | 0228211 | A1 | 7/1987 |
| EP | 0234911 | A1 | 9/1987 |
| EP | 0260789 | A1 | 3/1988 |
| EP | 0317154 | A1 | 5/1989 |
| EP | 0630587 | A1 | 12/1994 |
| EP | 0664089 | A1 | 7/1995 |
| EP | 0908110 | B1 | 8/2003 |
| EP | 2033531 | A1 | 11/2009 |
| FR | 2694166 | A3 | 2/1994 |
| FR | 2873899 | A1 | 2/2006 |
| GB | 706624 | | 3/1954 |
| WO | 8400478 | | 2/1984 |
| WO | 8401273 | | 4/1984 |
| WO | 2006027437 | A1 | 3/2006 |
| WO | 2009080368 | A1 | 7/2009 |

OTHER PUBLICATIONS

International Preliminary Report on Patentability mailed May 17, 2013 for International Patent Application No. PCT/GB2012/050531, filed Mar. 9, 2012.

International Search Report mailed Jun. 14, 2012 for International Patent Application No. PCT/GB2012/050531, filed Mar. 9, 2012.

Office Action, dated Oct. 7, 2014, for JP 2013-558500, referencing JP 61-31075 (equivalent to U.S. Pat. No. 4,593,707), JP 61-100180 (equivalent to U.S. Pat. No. 4,576,187), JP 4-262772 (equivalent to U.S. Pat. No. 5,105,838) and JP 11-103843 (equivalent to EP 0908110).

* cited by examiner

SMOKING ARTICLE AND METHOD OF MANUFACTURING A SMOKING ARTICLE

CLAIM FOR PRIORITY

This application is a National Stage Entry entitled to and hereby claiming priority under 35 U.S.C. §§365 and 371 to corresponding PCT Application No. PCT/GB2012/050531, filed Mar. 9, 2012, which in turn claims priority to GB Application No. 1104232.2, filed Mar. 14, 2011, and which also claims priority to GB Application No. 1114581.0, filed Aug. 23, 2011. The entire contents of the aforementioned applications are herein expressly incorporated by reference.

The present invention relates to a smoking article and method of manufacturing a smoking article. Preferably, the invention relates to a smoking article having a ventilation which can be controllably varied.

A smoking article with a variable ventilation is known from U.S. Pat. No. 4,699,158. The smoking article may be adjustable by rotation to vary air dilution by varying the degree of rotation between openings. The smoking article disclosed has a detent means comprising a plurality of discrete cut-outs which are engagable with a protuberance. A detent action is provided as the protuberance moves between the cut-outs. However, this smoking article may not provide a desired level of audible feedback when ventilation is varied.

The present invention provides, in a first aspect, a smoking article, comprising: a first part, a second part movable relative to the first part, and further comprising a control mechanism comprising a first control surface on one of the first part or second part; and a second control surface on the other of the first and second parts, wherein the second control surface is configured to engage with the first control surface to control relative movement between the first part and second part.

Thus, the smoking article has a first part which is controllably movable relative to a second part.

Preferably, the first part and/or second part comprise at least one ventilation area, wherein the relative position of the first part to the second part is configured to selectively control ventilation through the at least one ventilation area.

Preferably, the first control surface and/or second control surface comprises a continuous surface defining a plurality of circumferentially spaced depressions.

Preferably, the depressions are elongate grooves which extend substantially longitudinally, and adjacent grooves are separated by a ridge.

Preferably, the first part is rotatable relative to the second part, and the control mechanism is an indexing mechanism configured to control relative rotation between the first part and second part to select one of a plurality of indexing positions.

Preferably, the control mechanism is a guide mechanism configured to allow longitudinal movement of the second part relative to the first part, and prevent relative rotation between the first part and the second part.

The present invention provides, in a second aspect, a method of manufacturing a smoking article, comprising: providing a first part, providing a second part, and attaching the second part to the first part such that the second part is movable relative to the first part, and the first and second parts further comprising a control mechanism comprising a first control surface on one of the first part or second part; and a second control surface on the other of the first and second parts, wherein the second control surface is configured to engage with the first control surface to control relative movement between the first part and second part.

Embodiments of the present invention will now be described, by way of example only, with reference to the accompanying drawings, in which.

Figure 29A:
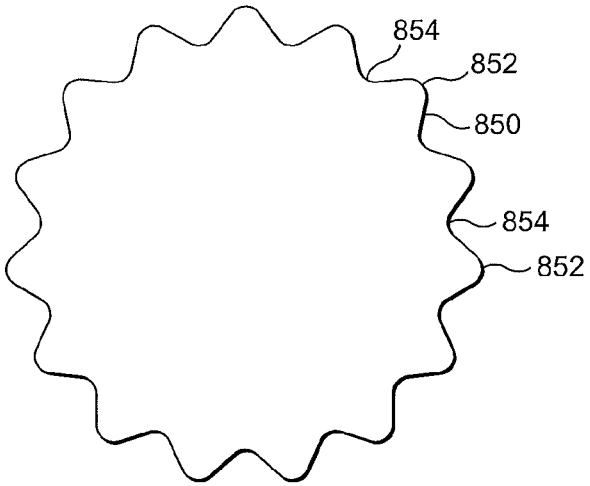
Figure 29B:
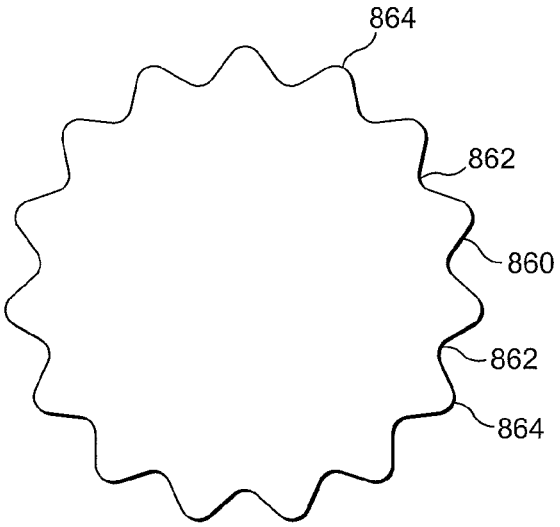

FIG. 29*a* is a side elevation view of a surface of a first part of a smoking article according to any embodiment; and FIG. 29*b* is a side elevation view of a surface of a second part of a smoking article according to any embodiment.

A smoking article according to any embodiment is briefly described. The smoking article may be an article such as a cigarette, cigar or cigarillo. For convenience, these will be referred to as "smoking articles" in this specification. The smoking article comprises a first part comprising a source of smokable material, which is preferably tobacco. The source of smokable material is in the form of a tobacco rod, preferably with an attached first filter. The tobacco rod and first filter are connected with a covering layer, preferably formed of tipping paper. The tobacco rod and first filter may be referred to as a tobacco unit.

A second part of the smoking article comprises a sleeve in the form of a cylindrical tube extending around the circumference of the tobacco rod and/or first filter. The sleeve is preferably formed as a cylinder of paper. The tobacco rod and first filter are dimensioned to rotate as a unit around a longitudinal axis within the sleeve.

The second part may optionally further comprise a second filter at a mouthpiece end of the sleeve, adjacent to, or connected with, the first filter. The second filter is securely attached and fixed within the sleeve. The first and/or second filters are preferably made of a conventional filtration material, e.g. cellulose acetate tow.

The tobacco rod and attached filter are described as connected by tipping paper. The tipping paper may be standard tipping paper, or a relatively thick recessed tipping paper, or a board type tipping paper. Alternatively, a tube formed of any material may attach the filter material to the source of smokable material. In particular, such a tube may be made of a plastics material, for example, a plastic made from corn starch. Alternatively, the tube may be made from a ceramic material. Alternatively, the tube may be formed from foil, metal or metallised paper.

The smoking article is provided with a ventilation system configured to allow adjustment of a ventilation of the smoking article. The ventilation is selected by selecting a position of the second part relative to the first part, which is controlled by a control mechanism. The control mechanism preferably provides tactile feedback and/or an audible sound indicating movement to or from the selected position.

FIGS. 1 to 5 show a first embodiment of smoking article 180. The smoking article 180 comprises a tobacco unit 181, which may comprise a source of smokable material in the form of a tobacco rod, and a filter 184. A first part comprising the tobacco unit 181 is moveable relative to a second part of the smoking article comprising a sleeve 183. The filter 184 is located within the sleeve 183, at a mouthpiece end. The tobacco rod is fixed to the filter 184. The sleeve 183 is rotatable relative to the tobacco unit 181, and the sleeve 183 is not movable longitudinally relative to the tobacco unit 181. The tobacco unit 181 has a rearward end, which is surrounded by the sleeve 183.

The sleeve 183 is provided with one or more first ventilation apertures 186 adjacent to a forward end. Preferably, the sleeve 183 comprises a single first ventilation aperture 186 extending longitudinally and circumferentially over a part only of the circumference. Preferably, the first ventilation aperture 186 has a substantially rectangular outline. The tobacco unit 181 comprises one or more second ventilation apertures 187 adjacent to a rearward end. Preferably, the tobacco unit 181 comprises a plurality of second ventilation apertures 187 in an array extending longitudinally and circumferentially over a part only of the circumference. The second ventilation apertures 187 may be formed on a plurality of parallel and longitudinally extending lines. The second ventilation apertures 187 allow ingress of air into tobacco unit 181, in particular into the filter and/or into the tobacco rod containing a source of smokable material. The second ventilation apertures 187 are formed in a tubular member 189 which is formed as a sleeve separate to the tobacco rod and filter of the tobacco unit 181. The tubular member 189 encircles and is affixed to the filter and/or tobacco rod 181, and is preferably formed of a sheet of flexible material, in particular, paper. The tubular member 189 may connect the filter to the tobacco rod, or may be attached to a filter and tobacco rod which are connected by another means, e.g. tipping paper (not shown).

Figure 1:
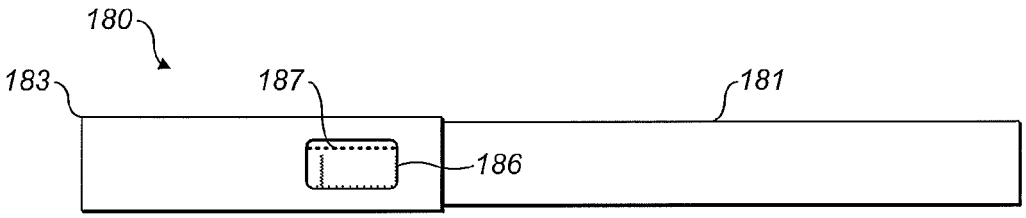
FIG. 1 is a side elevation view of a smoking article with a first embodiment of a variable ventilation system in a first state.

FIG. 1 shows the smoking article in a partially ventilating state. The first and second ventilation apertures 186,187 are partially aligned, allowing some ingress of air into the body of the filter and/or tobacco rod.

Figure 2:
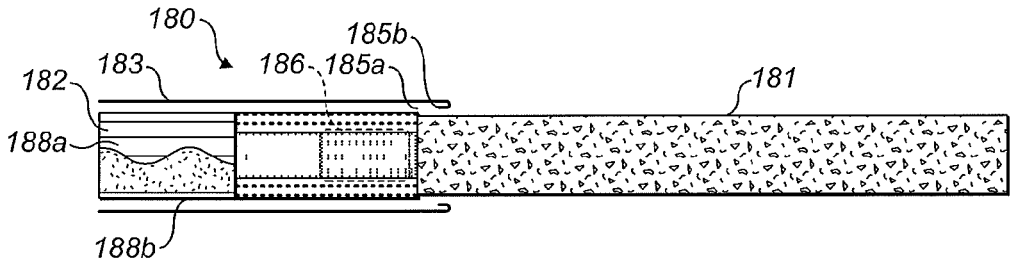
FIG. 2 is a cut-away side elevation view of a smoking article with the first embodiment of a variable ventilation system in a second state.

FIG. 2 shows the smoking article 180 in a minimum ventilating state. The first and second ventilation apertures 186, 187 are not rotationally aligned, preventing ventilation of the smoking article through ventilation apertures 186, 187.

Figure 3:
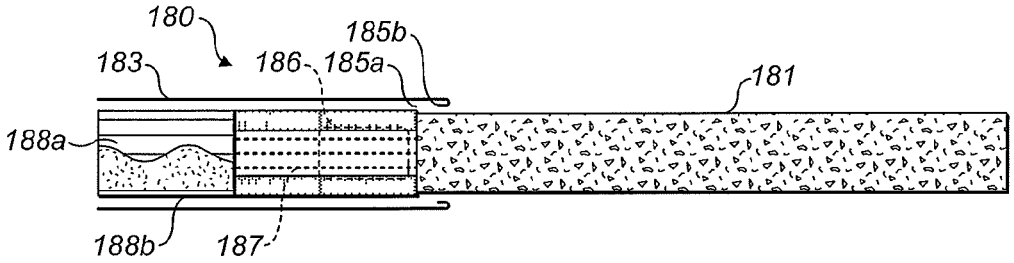
FIG. 3 is a cut-away side elevation view of a smoking article with the first embodiment of a variable ventilation system in a third state.

FIG. 3 shows the smoking article 180 in a maximum ventilating state. The first and second ventilation apertures 186, 187 are rotationally aligned, allowing ventilation of the smoking article through ventilation apertures 186, 187.

The smoking article 180 is configured such that an initial ventilation state can be selected as a minimum ventilation state, a maximum ventilation state or an intermediate ventilation state between the maximum and minimum values. For an initial ventilation state which is a minimum ventilation, rotation of the sleeve relative to the tobacco unit in one or either direction causes the ventilation to increase. The first and second ventilation apertures 186, 187 are not initially rotationally aligned, and are preferably formed in separate processes on the sleeve and tobacco unit, prior to the sleeve and tobacco unit being connected.

For an initial ventilation state which is a maximum ventilation, rotation of the sleeve relative to the tobacco unit in either direction causes the ventilation to decrease. The first and second ventilation apertures 186, 187 are initially fully rotationally aligned, and may be formed simultaneously in the same process when the sleeve is connected to the tobacco unit in the initial ventilation state. Alternatively, the first and second ventilation apertures are formed in separate processes on the sleeve and tobacco unit, prior to the sleeve and tobacco unit being connected.

For an initial ventilation state which is an intermediate ventilation, rotation of the sleeve relative to the tobacco unit in a first direction causes the ventilation to increase, and rotation of the sleeve relative to the tobacco unit in an opposite second direction causes the ventilation to decrease. The first and second ventilation apertures 186, 187 are initially partially rotationally aligned, and are preferably formed in separate processes on the sleeve and tobacco unit, prior to the sleeve and tobacco unit being connected.

FIGS. 2 and 3 show the smoking article 180 includes a restraining means for inhibiting longitudinal movement between the sleeve 183 and tobacco rod 181, and in particular, preventing separation of the sleeve 183 from the tobacco rod 181. The restraining means comprises first and second engaging surfaces 185*a*,185*b*. The first engaging surface 185*a* is preferably formed on a section of increased diameter, having a step change in diameter from a forward section of the tobacco unit. The forward facing first engaging surface 185*a* is preferably formed by a sheet material (e.g. paper) wrapped around the tobacco unit and forming a section of increased diameter. The first engaging surface 185*a* is preferably formed on a radially outwardly extending forward edge of the tubular member 189, or may be formed by tipping paper or another sheet material wrapped around the tobacco unit.

The second engaging surface 185*b* is provided within an interior surface of the cylindrical tube forming the sleeve. The second engaging surface 185*b* is formed between the forward and rearward ends of the sleeve, and inside of the cylindrical sleeve forming an exterior surface of the sleeve. The second engaging surface 185*b* is therefore formed within an exterior surface of the second part. The second engaging surface 185*b* is provided on an inwardly folded section of the sleeve 183, formed by folding a forward end of a blank for forming the sleeve. The restraining means 185*a*,185*b* allows free rotation whilst preventing removal or rearward longitudinal movement of the sleeve 183 relative to the tobacco unit 181.

Figure 4:
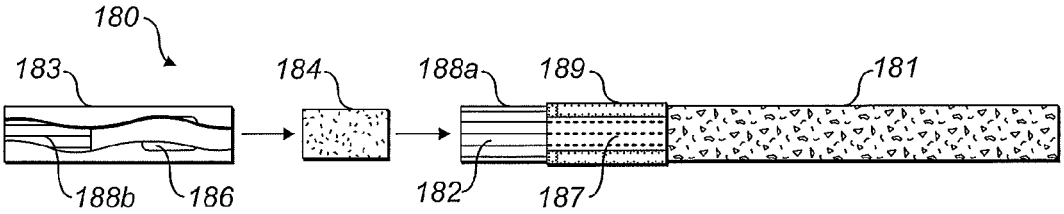
FIG. 4 is an exploded cut-away side elevation view of a smoking article with the first embodiment of a variable ventilation system in the third state.

FIG. 4 shows an exploded view of the smoking article 180. The smoking article 180 comprises a tobacco unit 181 having a filter 184 attached.

As shown in FIGS. 2 to 4, the smoking article 180 comprises a control mechanism in the form of an indexing mechanism, configured to control rotation between the sleeve 183 and tobacco unit 181. The indexing mechanism comprises a first indexing section 188*a* on the tobacco unit which is engaged with a second indexing section 188*b* on the sleeve 183. The sleeve 183 is rotatable relative to the tobacco unit 181 into a plurality of pre-determined indexed rotational positions. The indexed positions are narrowly spaced, providing for incremental step-wise movement. The indexing mechanism of the present invention provides an angle of rotation which may be finely controlled and maintained. The indexing mechanism provides a large number of indexed positions, at least three, preferably at least seven, and more preferably 10, or 12, 15, 20, 22 or more. Preferably, the indexing mechanism provides 18-25 positions, and more preferably 20 to 22 positions. The index mechanism provides for a substantially continuous rotation between the first part and second part.

The tobacco unit 181 comprises the first indexing section 188*a* at its rearward end, and surrounded by the sleeve 183. The first indexing section 188*a* preferably has plurality of depressions which are engagable by a protruding feature on the second indexing section. The depressions preferably form a corrugated exterior surface. In particular, the first indexing section 188*a* has an outer surface which is not smooth, and preferably comprises a plurality of elongate grooves, separated by ridges, which extend substantially longitudinally. The plurality of ridges and grooves may define a sinuous outer surface, which smoothly oscillates in radius. The ridge between adjacent depressions may have a curved profile with a substantially uniform radius of curvature. The ridge between adjacent depressions defines a single circumferential point of maximum resistance to movement of the engaging feature between the adjacent depressions. Alternatively, the grooves may be formed as flutes, having a concave profile. The ridge between adjacent depressions may have a pointed, creased, or tapering profile, having a substantially sharp point of maximum radius. The ridge between adjacent depressions defines a single circumferential point of maximum resistance to movement of the engaging feature between the adjacent depressions. This shape provides for a loud sound when the first and second parts are rotated relative to each other, providing clear audible feedback that the ventilation has been changed.

The first indexing section may be formed on any exterior surface of the first part of the smoking article. In particular, the first indexing section 188*a* may be formed on a tubular indexing member 182 surrounding the filter 184. The tubular indexing member 182 surrounding the filter is separate to the filtration material and plugwrap forming the filter, and may optionally connect the filter to the tobacco rod. The tubular indexing member 182 defining the first indexing section 188*a* may be a cylinder of cellulose acetate or paper sleeve having depressions and/or protrusions as described above, and may be attached to the filter by an adhesive. The features of the first indexing section 188*a* are formed when the indexing member 182 is a blank prior to forming a tube, and prior to attachment of the indexing member 182 to the filter and/or tobacco rod.

The indexing grooves and ridges preferably extend around the whole circumference of the tobacco unit, or alternatively, extend around only a part of the circumference of the tobacco unit. The indexing grooves and ridges may extend over the whole length or only a part of the length of the indexing member 182.

Alternatively, the first indexing section 188*a* is formed in a radially facing curved exterior surface of the filter. The filter having an exterior surface with the indexing section comprises filtration material, preferably formed in a cylinder extending longitudinally. The filtration material is any known filtration material, and in particular, is formed of cellulose acetate tow. The filtration material is wrapped in one or more sheets of flexible material. Preferably, the sheet material is paper, and may be known as plugwrap. The paper extends around the curved sides of the cylinder of filtration material. The paper forms, or supports, a continuous outer surface defining the grooves and ridges of the first indexing section. The paper is deformed to form the grooves and ridges, and treated such that the shape of the grooves and ridges are permanently maintained in the paper. The paper is shaped to define grooves and ridges before it is wrapped around the filtration material. The paper plugwrap is not cut to define the grooves. The paper may be deformed by embossing, extrusion, crimping or applying any form of pressure, in particular using rollers. The paper may be heated during formation of the depressions.

The paper material wrapping the filtration material is optionally overwrapped by a film. The film provides a continuous exterior surface defining the plurality of grooves. The film is preferably a plastics material, in particular a polymer, for example, polypropylene. The film may be transparent, or may be opaque. The plastics film provides an exterior surface which may be more rigid than the grooves and ridges formed in the supporting paper alone. The film inhibits the grooves and ridges being smoothed out by contact with the engaging part of the indexing mechanism during rotation. The film is applied to grooves and ridges which have already been formed in the paper plugwrap. The pre-determined high rigidity of the exterior surface provides for a large volume of sound, as the indexing mechanism is moved from one index position to the next.

The sleeve 183 comprises a second indexing section 188*b*. The second indexing section 188*b* is located on the interior of the sleeve 183, at the rearward end, and has one or more features engagable with the first indexing section 188*a*. The second indexing section 188*b* may have substantially the same profile and formation as the first indexing section 188*b*, and dimensioned to fit around the first indexing section 188*b*. The second indexing section 188*b* preferably has a corrugated inner surface. In particular, the first indexing section 188*b* has an interior surface which is not smooth, and preferably comprises a plurality of elongate grooves, separated by ridges, which extend substantially longitudinally.

The plurality of ridges and grooves may define a sinuous outer surface, which smoothly oscillates in radius. The ridge between adjacent depressions may have a curved profile with a substantially uniform radius of curvature. The ridge between adjacent depressions defines a single circumferential point of maximum resistance to movement of the engaging feature between the adjacent depressions. Alternatively, the grooves may be formed as flutes, having a concave profile. The ridge between adjacent depressions may have a pointed, creased or tapering, profile, having a substantially sharp point of maximum radius. The ridge between adjacent depressions defines a single circumferential point of maximum resistance to movement of the engaging feature between the adjacent depressions. Thus, both the first and second indexing sections may provide protrusions which engage in depressions in the other of the first and second indexing sections. Alternatively, only one of the first and second indexing sections may have indexing depressions which are engagable by a protrusion on the other of the first and second indexing sections.

The second indexing section 188*b* may be formed by a sheet of flexible material, e.g. cellulose acetate or paper, which is corrugated, formed into a tube and affixed to an inner surface of the sleeve 183. Preferably, the second indexing section 188*b* has substantially the same, or similar, configuration and shape to the first indexing section 188*a*. The second indexing section 188*b* may be overwrapped with a film, substantially as described with respect to the first indexing section 188*a*.

The method of manufacture of an exemplary tubular indexing member defining the first or second indexing section 188*a*,188*b* is now described. The tubular indexing member is formed from a blank of sheet material, preferably cellulose acetate, or alternatively, paper. The cellulose acetate sheet may be formed from steam treated cellulose acetate tow, which is rolled with one or more rollers to form a strip of sheet material. The strip of sheet material is passed through one or more crimping rollers in order to corrugate the sheet material. The sheet material is deformed such that both sides define the grooves and ridges. The deformed sheet material is then wrapped around a filter (including plugwrap) and/or tobacco rod of the tobacco unit. The wrapped sheet material is held in the form of a tube by an adhesive applied on a lap seam along the length of the tubular member, similarly to formation of tipping paper around a conventional smoking article.

Alternatively, the first and second indexing sections 188*a*, 188*b* may engage with different configurations. In particular, the first or second indexing section 188*a*,188*b* may comprise one or more discrete protrusions extending radially outwardly or inwardly from the interior of the sleeve 183 respectively. The protrusion is configured to engage in the grooves of the other of the first or second indexing section 188*b*,188*a* to control rotation. The protrusion may be formed by a dot of raised ink, dot of glue, by an indent, by an embossing, or by any other suitable means to engage with the first indexing section. The first and second indexing surfaces are provided on two adjacent areas of the first and second parts The first and/or second indexing sections 188*a*,188*b* are resiliently deformable to allow the protruding features of each part to releasably engage. Application of a rotational force above a threshold level causes resilient deformation of the first and/or second indexing sections 188*a*, providing for rotation to the next indexed position where features of each part engage.

Rotation of the sleeve 183 may be accompanied with an audible sound, e.g. a click, at each pre-determined position. The indexing mechanism functions to resist rotation between the first and second parts of the smoking article, unless sufficient force is applied and the parts rotate to the next indexed position. The indexing mechanism provides feedback to a user that the first and second parts have been rotated, preferably in the form of touch in the indexing movement and/or sound as each indexing position is engaged. The indexing mechanism does not limit rotation to a predefined range of rotation. Alternatively, the first and/or second indexing sections 188*a*,188*b* may limit rotation to a range of between 90° and 180°, and preferably to a range of approximately 120°.

The sleeve 183 is restrained from moving forwardly over the tobacco unit. The ridges (radially innermost areas) of the second indexing section 188*b* are configured to engage with a part of the tobacco unit. The ridges of the second indexing section 188*b* extend over only a part of the length of the sleeve and a forward edge engages with a part of the tobacco unit which has a radius greater than the grooves of the first indexing section 188*a*. In particular, the forward edge of second indexing section 188*b* engages with the tubular member 189 or other part of the tobacco unit which is not grooved and has a radius greater than the ridges of the second indexing section 188*b*.

Figure 5:
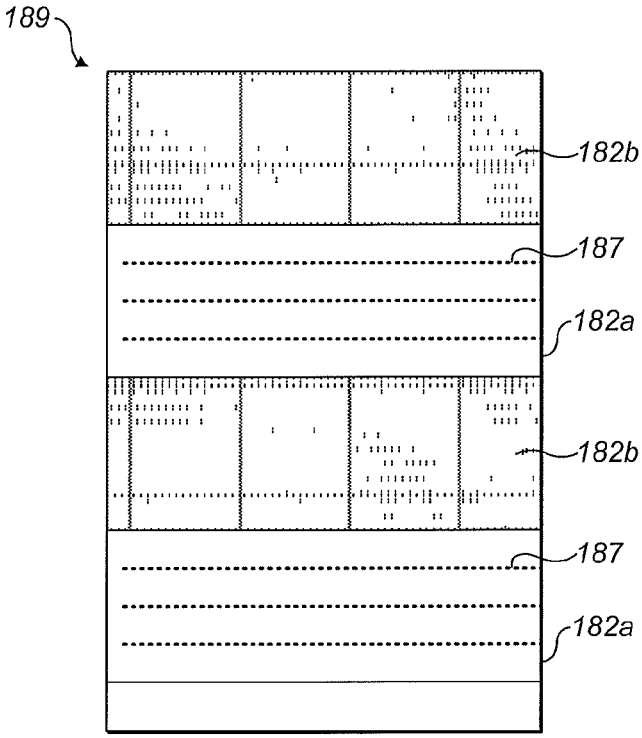
FIG. 5 is a plan view of a part of the smoking article with the first embodiment of a variable ventilation system.

Referring to FIGS. 4 and 5, the tubular member 189 on the tobacco unit 181 is formed from a blank of air impermeable sheet material e.g. paper. The member 189 surrounds the tobacco unit 181, forwardly of the first indexing section 188*a*. FIG. 5 shows the blank prior to forming into a tube. The blank 189 has a surface comprising a first set of ventilation areas 182*a* allowing ingress of air through a plurality of second ventilation apertures 187 located within the ventilation areas 182*a*. Preferably, the blank comprises a first and second set of ventilation areas 182*a* spaced circumferentially. The blank 189 additionally has an air impermeable section 182*b* which prevents ingress of air. Preferably, there are two ventilation areas 182*b* spaced circumferentially and alternating with the ventilation areas 182*a*.

The sleeve 183 surrounds the member 189, and the first ventilation aperture 186 overlies the member 189. The rotational alignment of the first and second ventilation apertures 186,187, as controlled by the indexing sections 188*a*,188*b*, determines the ventilation of the smoking article 180.

The smoking article 180 is described as having a filter 184 attached to the tobacco rod. Alternatively, the smoking article may comprise a first and second filter. A first filter (not shown) may be attached to the tobacco rod, and the second filter attached to the first filter. The second filter is fixed relative to the tobacco rod. Alternatively, the second filter may be attached to the sleeve, and rotate with the sleeve relative to the first filter.

FIGS. 6 to 9 show a second embodiment of smoking article 190. Smoking article 190 is formed substantially as described in the embodiment above. The smoking article 190 comprises a tobacco unit 191, which may comprise a tobacco rod and a filter. A first part comprising the tobacco unit 191 is moveable relative to a second part of the smoking article comprising a sleeve 193. The sleeve 193 is rotatable relative to the tobacco unit 191, and the sleeve 193 is not movable longitudinally relative to the tobacco unit 191. The tobacco unit 191 has a rearward end, which is surrounded by the sleeve 193.

The sleeve 193 is provided with one or more first ventilation apertures 196 adjacent to a forward end. Preferably, the sleeve 193 comprises a plurality of first ventilation apertures 196 in an array extending longitudinally and circumferentially, and preferably a rectangular area. Preferably, the sleeve 193 comprises two arrays of first ventilation apertures 196 spaced circumferentially.

The tobacco unit 191 comprises one or more second ventilation apertures 197 adjacent to a rearward end. Preferably, the tobacco unit 191 comprises two sets of second ventilation apertures 197 spaced circumferentially, preferably each being a single aperture, and surrounded by an air-impermeable surface. Alternatively, the tobacco unit 191 comprises a single second ventilation aperture 197 extending longitudinally and circumferentially.

Figure 6:
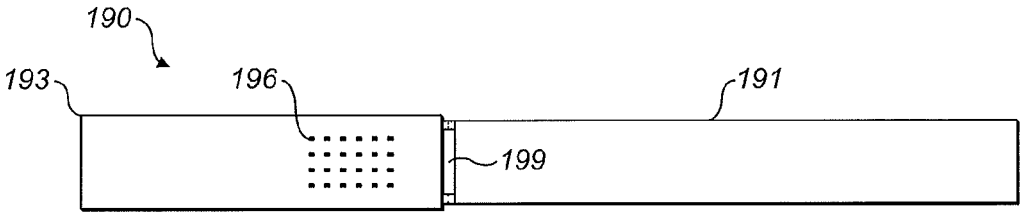
FIG. 6 is a side elevation view of a smoking article with a second embodiment of a variable ventilation system in a first state.

FIG. 6 shows the smoking article in a minimum ventilating state. The first and second ventilation apertures 196,197 are not aligned, preventing ingress of air into the filter and/or tobacco rod of the tobacco unit.

Figure 7:
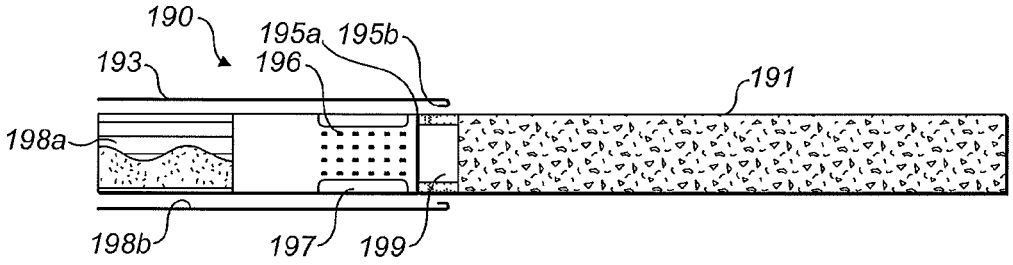
FIG. 7 is a cut-away side elevation view of a smoking article with the second embodiment of a variable ventilation system in the first state.

FIG. 7 shows the smoking article 190 in the minimum ventilating state. The first and second ventilation apertures 196, 197 are not rotationally aligned, preventing ventilation of the smoking article through ventilation apertures 196, 197.

Figure 8:
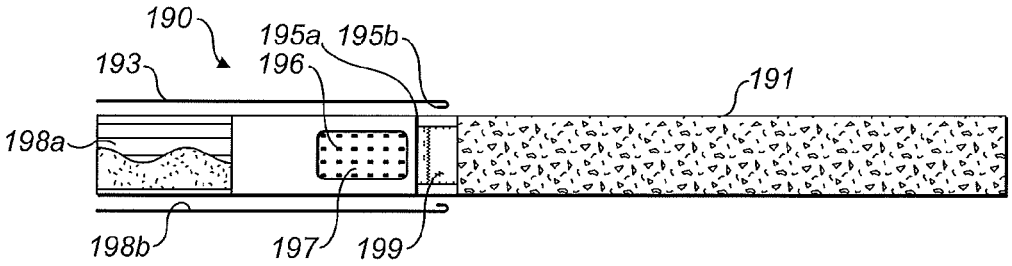
FIG. 8 is a cut-away side elevation view of a smoking article with the second embodiment of a variable ventilation system in a second state.

FIG. 8 shows the smoking article 190 in a ventilating state. The first and second ventilation apertures 196, 197 are rotationally aligned, allowing ventilation of the smoking article through ventilation apertures 196, 197 into the body of the filter and/or tobacco rod.

FIGS. 7 and 8 show a restraining means for inhibiting longitudinal movement between the sleeve 193 and tobacco rod 191. The restraining means comprises first and second engaging surfaces 195*a*,195*b*. The restraining means 195*a*, 195*b* is configured in substantially the same or similar manner, and performs the same or similar function, as the first and second engaging surfaces 185*a*,185*b* described with respect to FIGS. 1 to 5. In smoking article 190, the first engaging surface 195*a* is preferably formed by a sheet of flexible material, e.g. paper, wrapped around the tobacco unit. The sheet of flexible material may be formed as a separate tube formed from a blank and attached to the tobacco rod and filter, substantially as described for the tubular member 189 described with respect to FIGS. 1 to 5.

Figure 9:
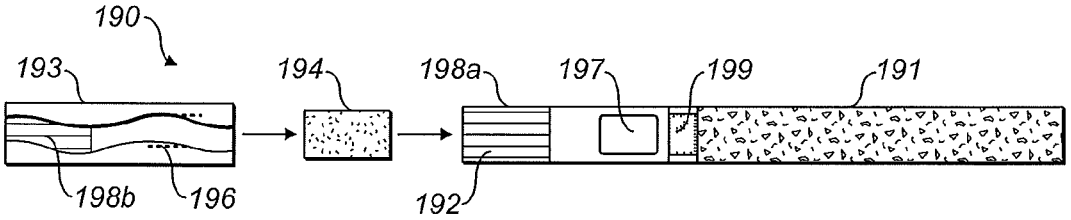
FIG. 9 is an exploded cut-away side elevation view of a smoking article with the second embodiment of a variable ventilation system in the second state.

FIG. 9 shows an exploded view of the smoking article 190. The smoking article 190 comprises a tobacco unit 191 having a filter attached to the tobacco rod.

As shown in FIGS. 7 to 9, the smoking article 190 comprises a control mechanism in the form of an indexing mechanism configured to control rotation between the sleeve 193 and tobacco unit 191. The indexing mechanism comprises a first indexing section 198*a* on the tobacco unit which is engaged with a second indexing section 198*b* on the sleeve 193. The sleeve 193 is rotatable relative to the tobacco unit 191 into a plurality of pre-determined indexed rotational positions. The indexing mechanism is configured in the same or similar manner, and performs the same or similar function, as the indexing mechanism described with respect to FIGS. 1 to 5. In particular, the first indexing sections and/or second indexing section 198*b* 198*a* is a corrugated surface formed in the exterior of a tubular member 192 or surface of the filter. The first and/or second indexing section may comprise a film overwrap.

The smoking article 190 is provided with an indicator for indicating the ventilation. The indicator comprises a marking 199 on the tobacco unit 191 which is visible beyond the sleeve 193. The marking 199 is aligned with the second ventilation apertures 197. Alignment of the marking 199 with the first ventilation apertures 196 indicates the first ventilation apertures 196 and second ventilation apertures 197 are aligned, and ventilation is provided. Partial alignment of the marking 199 with the first ventilation apertures 196 indicates a corresponding partial ventilation.

The smoking article 190 is configured such that an initial ventilation state can be selected as a minimum ventilation state, a maximum ventilation state or an intermediate ventilation state between the maximum and minimum values, as described with respect to FIGS. 1 to 5.

Figure 10:
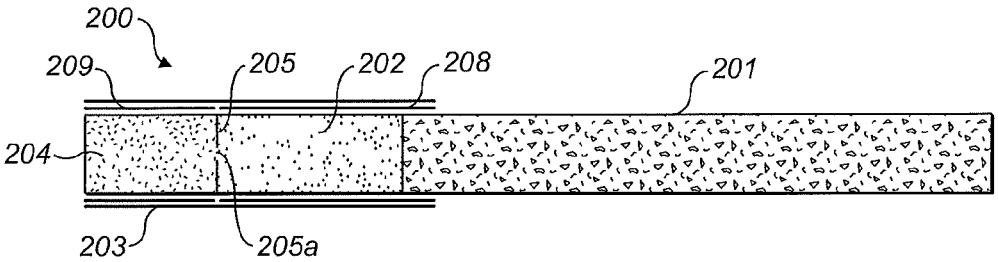
FIG. 10 is a cut-away side elevation view of a smoking article with the third embodiment of a variable ventilation system in a first state.
Figure 11:
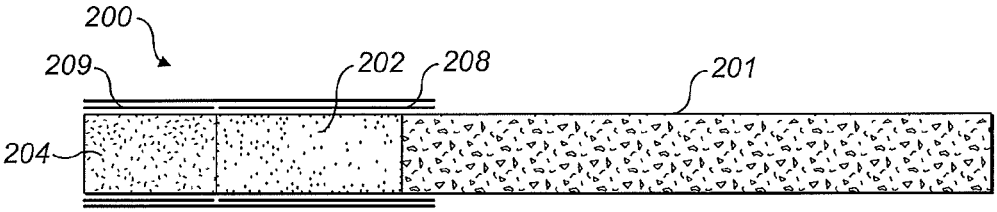
FIG. 11 is a cut-away side elevation view of a smoking article with the third embodiment of a variable ventilation system in a second state.
Figure 12:
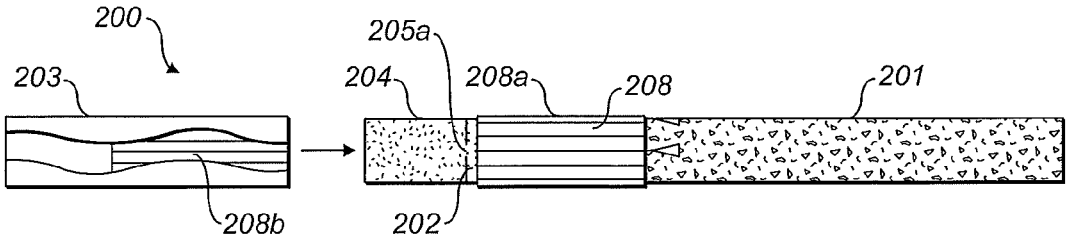
FIG. 12 is an exploded cut-away side elevation view of a smoking article with the third embodiment of a variable ventilation system in the first state.

FIGS. 10 to 12 show a third embodiment of smoking article 200. Smoking article 200 is formed substantially as described in any of the embodiments above. The smoking article 200 comprises a tobacco unit 201, which may comprise a tobacco rod and a first filter 202. A first part comprising the tobacco unit 201 is moveable relative to a second part of the smoking article comprising a sleeve 203. The tobacco unit 201 is adjacent, and rotatably connected to, a second filter 204 fixed to the sleeve 203. The sleeve 203 is rotatable relative to the tobacco unit 201, and the sleeve 203 is not movable longitudinally relative to the tobacco unit 201. The tobacco unit 201 has a rearward end, which is surrounded by the sleeve 203.

The sleeve is provided with one or more first ventilation apertures (not shown) at one or more circumferential positions. The first ventilation aperture may extend circumferentially over only a part of the circumference, and preferably, is formed by a circumferentially extending slit allowing ventilation through the sleeve.

The tobacco unit is provided with one or more second ventilation apertures (not shown) at one or more circumferential positions. The second ventilation aperture may extend circumferentially over only a part of the circumference, and preferably, is formed by a circumferentially extending slit allowing ventilation into the tobacco unit, i.e. into a filter or tobacco rod. Alternatively, the first and second ventilation apertures may extend longitudinally at a circumferential position or range, or extend both longitudinally and circumferentially.

The lengths of the circumferential slits forming the first and second ventilation apertures may be equal to a range of rotational movement, such that the ventilation apertures are rotatable between a fully aligned position, and a non-aligned position in which the ventilation apertures are circumferentially adjacent but not aligned.

In the minimum ventilating state, the first and second ventilation apertures are not aligned. In a ventilating state, the first and second ventilation apertures are aligned. The state of ventilation is selected by relative rotation of the sleeve and tobacco unit. The first and second filters 202,204 twist relative to each other as required to select an overlap or alignment of the first and second ventilation apertures.

The smoking article 200 is configured such that an initial ventilation state can be selected as a minimum ventilation state, a maximum ventilation state or an intermediate ventilation state between the maximum and minimum values, as described with respect to FIGS. 1 to 5.

FIG. 10 shows the smoking article 200 in a non-ventilating state. The first and second filters 202,204 are formed as a single integral filter. The first filter 202 is partially separated from the second filter 204 by a lateral cut 205. The lateral cut 205 extends over a radially outer part of the first and second filters 202,204. A radially inner core 205*a* connects the first and second filters 202,204. The central core 205*a* of filtration material maintains the attachment of the first filter to the second filter.

FIG. 11 shows the smoking article 200 in a ventilating state. The first and second filters 202,204 have been rotated relative to each other, with the central core 205*a* twisting around a longitudinal axis. The central core 205*a* maintains the attachment of the first filter to the second filter whilst twisted. FIG. 12 shows an exploded view of the smoking article 200. The smoking article 200 comprises a tobacco unit 201 having a first filter 202 attached to the tobacco rod. The second filter 204 is attached to and located rearwardly of the first filter. The second filter 204 is adjacent to, and rotatable relative to, the first filter 202.

As shown in FIG. 12, the smoking article 200 comprises a control mechanism in the form of an indexing mechanism configured to control rotation between the sleeve 203 and tobacco unit 201. The indexing mechanism comprises a first indexing section 208*a* on the tobacco unit which is engaged with a second indexing section 208*b* on the sleeve 203. The sleeve 203 is rotatable relative to the tobacco unit 201 into a plurality of pre-determined indexed rotational positions. The indexing mechanism is configured in substantially the same or similar manner, and performs the same or similar function, as the first and second indexing sections described with respect to FIGS. 1 to 5. In particular, the first indexing section 208*a* is a corrugated surface formed on a sleeve 208 attached to an exterior surface of the first filter. The sleeve 208 is affixed around the first filter, and may optionally also be affixed to the tobacco rod to connect the first filter to the tobacco rod. The first and/or second indexing section may comprise a film overwrap. Alternatively, the indexing section 208*a* may be formed on an exterior of the first filter and/or tobacco rod, e.g. the grooves and ridges are formed on a wrap around filtration material. The rotational alignment of the first and second filters 202,204, as controlled by the indexing sections 208*a*,208*b*, determines the ventilation of the smoking article 200.

The smoking article 200 is provided with an indicator for indicating the relative rotation of the sleeve and tobacco unit, and so indicates the ventilation. The indicator comprises at least one marking on the tobacco unit 201 which is visible beyond the sleeve 203. Preferably, the tobacco unit 201 is provided with a first and a second circumferentially spaced markings. The markings are alignable with a marking on the sleeve. Alignment of the first marking with the marking on the sleeve indicates ventilation is inhibited. Alignment of the second marking with the marking on the sleeve ventilation is provided.

A shim 209 may be located between the sleeve 203 and second filter 204. The shim 209 has an exterior surface which substantially matches the radius of sleeve 208 to allow the sleeve 203 to extend substantially longitudinally. The shim 209 may be a tubular member, preferably of paper, adhered to the sleeve and second filter.

Figure 13:
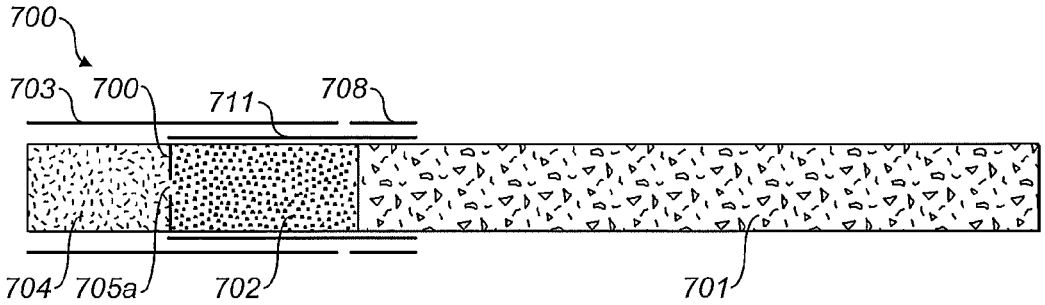
FIG. 13 is a cut-away side elevation view of a smoking article with a fourth embodiment of a variable ventilation system in a first state.
Figure 14:
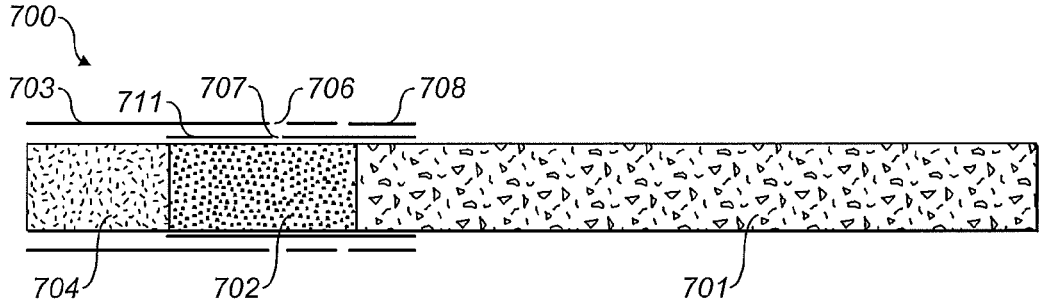
FIG. 14 is a cut-away side elevation view of a smoking article with the fourth embodiment of a variable ventilation system in a second state.
Figure 15:
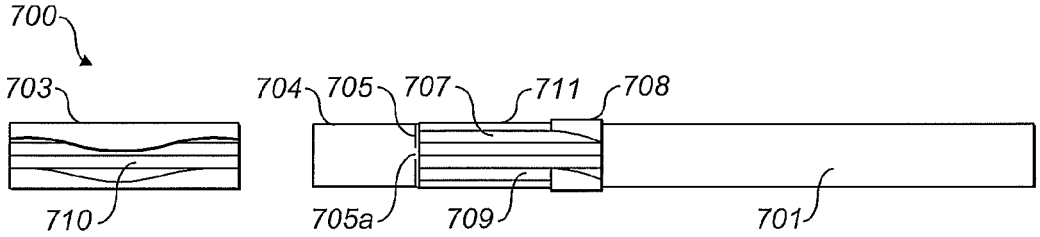
FIG. 15 is an exploded cut-away side elevation view of a smoking article with the fourth embodiment of a variable ventilation system in the first state.

FIGS. 13 to 15 show a fourth embodiment of smoking article 700. Smoking article 700 is formed substantially as described in any of the embodiments above. The smoking article 700 comprises a tobacco unit 701, which may comprise a tobacco rod and a filter 702. A first part comprising the tobacco unit 701 is moveable relative to a second part of the smoking article comprising a sleeve 703. The tobacco unit 701 is adjacent, and rotatably connected, to a second filter 704. The sleeve 703 is rotatable relative to the tobacco unit 701, and the sleeve 703 is not movable longitudinally relative to the tobacco unit 701. The tobacco unit 701 has a rearward end, which is surrounded by the sleeve 703.

The sleeve is provided with one or more first ventilation apertures 706 at one or more circumferential positions or ranges. The first ventilation aperture may extend circumferentially over only a part of the circumference, and preferably, is formed by a circumferential slit allowing ventilation through the sleeve.

The tobacco unit is provided with one or more second ventilation apertures 707 at one or more circumferential positions. The second ventilation aperture may extend circumferentially over only a part of the circumference, and preferably, is formed by a circumferential slit allowing ventilation into the tobacco unit, i.e. into a filter or tobacco rod. The lengths of the circumferential slits forming the ventilation apertures may be equal to the range of rotational movement, such that the ventilation apertures are movable between a fully aligned position, and a non-aligned position in which the ventilation apertures are circumferentially adjacent but not aligned.

FIG. 13 shows the smoking article 700 in a non-ventilating state. In the non-ventilating state, the first and second ventilation apertures 706,707 are not aligned. In a ventilating state, the first and second ventilation apertures are aligned. The state of ventilation is selected by relative rotation of the sleeve and tobacco unit. The first and second filters 702,704 twist relative to each other as required to select an overlap or alignment of the first and second ventilation apertures. Alternatively, the first and second ventilation apertures may extend longitudinally at a single circumferential position, or extend both longitudinally and circumferentially.

The smoking article 700 is configured such that an initial ventilation state can be selected as a minimum ventilation state, a maximum ventilation state or an intermediate ventilation state between the maximum and minimum values, as described with respect to FIGS. 1 to 5.

The first and second filters 702,704 are formed as a single integral filter. The first filter 702 is partially separated from the second filter 704 by a lateral cut 705. The cut 705 extends over a radially outer part of the first and second filters 702,704. A radially inner core 705*a* connects the first and second filters 702,704. The central core 705*a* of filtration material maintains the attachment of the first filter to the second filter.

FIG. 14 shows the smoking article 700 in a ventilating state. The first and second ventilation apertures 706,707 are aligned. The first and second filters 702,704 have been rotated relative to each other, with the central core 705*a* twisting around a longitudinal axis. The central core 705*a* maintains the attachment of the first filter to the second filter whilst twisted.

FIG. 15 shows an exploded view of the smoking article 700. The smoking article 700 comprises a tobacco unit 701 having a first filter 702 attached to the tobacco rod. A second filter 704 is attached to and located rearwardly of the first filter. The second filter 704 is adjacent to, rotatable relative to, the first filter 702.

As shown in FIG. 15, the smoking article 700 comprises a control mechanism in the form of an indexing mechanism configured to control rotation between the sleeve 703 and tobacco unit 701. The indexing mechanism comprises a first indexing section 709 on the tobacco unit which is engaged with a second indexing section 710 on the sleeve 703. The sleeve 703 is rotatable relative to the tobacco unit 701 into a plurality of pre-determined indexed rotational positions. The indexing mechanism is configured in substantially the same or similar manner, and performs the same or similar function, as the first and second indexing sections described with respect to FIGS. 1 to 5. The first indexing section 709 is formed on a tubular indexing member 711 which is fixedly attached to the first filter and/or tobacco rod. The grooves and ridges are formed in a blank of material, preferably cellulose acetate or paper, which is then attached to the tobacco unit around the first filter, and optionally also around the tobacco rod. The tubular indexing member 711 may connect the filter to the tobacco rod, or may be attached to the first filter and tobacco rod which are connected by another means, e.g. tipping paper (not shown). The first and/or second indexing section may comprise a film overwrap, substantially as described with respect to FIGS. 1 to 5.

The first indexing section 709 preferably extends over substantially the whole length of the first filter, and optionally over a part of the length of the tobacco rod. The second indexing section may extend over the whole length of the sleeve. Alternatively, the second indexing section 710 may extend over only a forward part of the sleeve, corresponding to the first indexing section 709. The rotational alignment of the first and second parts, as controlled by the indexing sections 709,710, determine the ventilation of the smoking article 700.

A forward end of the sleeve 703 abuts a rearward facing surface formed on a raised section 708. The raised section 708 is preferably one or more layers of flexible material, preferably paper, surrounding the first filter and/or tobacco rod. The raised section 708 has an exterior surface which is preferably flush with an exterior surface of the sleeve 703. The raised section 708 may be formed by folding outwardly and back a forward end of the sleeve 711, or may be a strip of sheet material e.g. paper, affixed to an exterior of the indexing member 711.

The smoking article 700 is provided with an indicator for indicating the relative rotation of the sleeve and tobacco unit, and so indicates the ventilation. The indicator comprises at least one marking on the tobacco unit 701 which is visible beyond the sleeve 703. Preferably, the tobacco unit 701 is provided with a first and a second circumferentially spaced marking. The markings are formed on the raised section 708, and are alignable with a marking on the sleeve. Alignment of the first marking with the marking on the sleeve indicates ventilation is inhibited. Alignment of the second marking with the marking on the sleeve indicates ventilation is provided.

Figure 16:
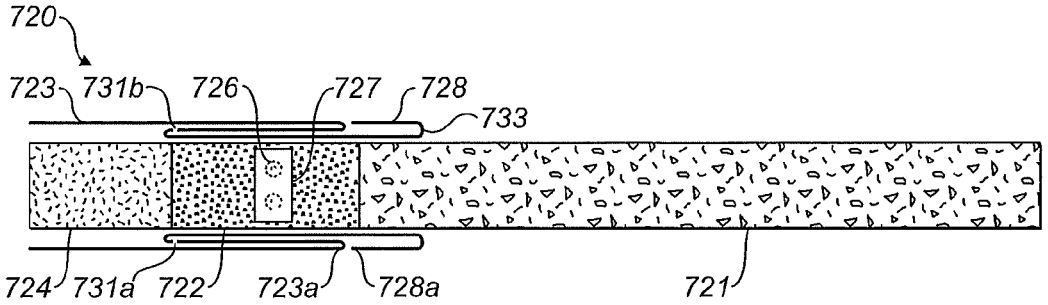
FIG. 16 is a cut-away side elevation view of a smoking article with a fifth embodiment of a variable ventilation system in a first state.
Figure 17:
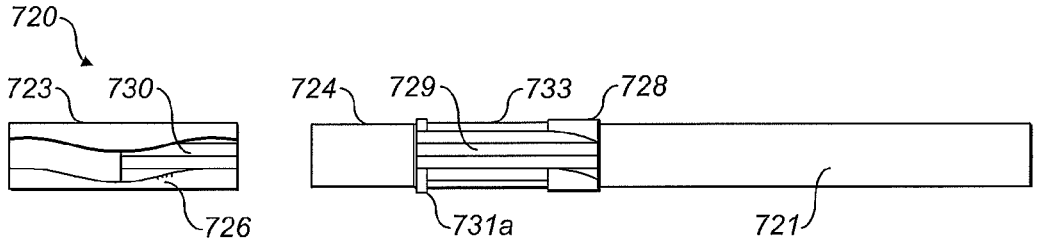
FIG. 17 is an exploded cut-away side elevation view of a smoking article with the fifth embodiment of a variable ventilation system.

FIGS. 16 and 17 show a fifth embodiment of smoking article 720. Smoking article 720 is formed substantially as described in any of the embodiments above. The smoking article 720 comprises a tobacco unit 721, which may comprise a tobacco rod and a first filter 722. A first part comprising the tobacco unit 721 is moveable relative to a second part of the smoking article comprising a sleeve 723. The tobacco unit 721 is adjacent to a second filter 724. The second filter 724 is fixed to the sleeve 723 and is located rearwardly of, and abutting, the separate first filter 722. The second filter 724 is rotatable relative to the first filter 722 as the first part is rotatable relative to the second part.

The sleeve 723 is rotatable relative to the tobacco unit 721, and the sleeve 723 is not movable longitudinally relative to the tobacco unit 721. The tobacco unit 721 has a rearward end, which is surrounded by the sleeve 723.

The sleeve 723 is provided with one or more first ventilation apertures 726 at one or more circumferential positions. The first ventilation aperture may extend circumferentially over only a part of the circumference. Preferably, the first ventilation apertures comprise a first and second aperture 726 which are circumferentially spaced. The tobacco unit 721 is provided with one or more second ventilation apertures 727 in an exterior air impermeable surface at one or more circumferential positions. The second ventilation aperture may extend circumferentially over only a part of the circumference, and preferably, is formed by a single aperture extending circumferentially and longitudinally. The second ventilation aperture 727 may selectively extend over none, one or all of the first ventilation apertures.

In the non-ventilating state, the first and second ventilation apertures 726,727 are not aligned. In a ventilating state, the first and second ventilation apertures 726,727 are aligned. The state of ventilation is selected by relative rotation of the sleeve and tobacco unit. The first and second filters 722,724 rotate freely relative to each other as required to select an overlap or alignment of the first and second ventilation apertures.

FIG. 16 shows the smoking article 720 in a ventilating state. The first and second ventilation apertures 726,727 are aligned. The ventilation of the smoking article 720 is variable by relative rotation between the sleeve and tobacco unit, without extending the smoking article.

The sleeve 723 is prevented from longitudinal movement over the tobacco unit by a restraining means. The restraining means comprises a first and second engaging surfaces 731*a*, 731*b* preventing rearward movement of the sleeve 723 relative to the tobacco unit 721.

The first engaging surface 731*a* on the tobacco unit is preferably formed on a section of increased diameter, having a step change in diameter from an adjacent forward section of the tobacco unit. The forward facing first engaging surface 731*a* is preferably formed on a tubular member 733 formed from a blank of a sheet material (e.g. paper or cellulose acetate) wrapped around the tobacco unit. The first engaging surface 731*a* is preferably formed by folding outwardly and forwardly a rearward edge of the tubular member 733, or may be formed by tipping paper or another sheet material wrapped around the tobacco unit or tubular member 733.

The second engaging surface 731*b* is provided within an interior surface of the cylindrical tube forming the sleeve 733. The second engaging surface 731*b* is provided on an inwardly folded section of the sleeve 733, formed by folding inwardly a forward end of the sleeve blank.

The second engaging surface 731*b* is formed between the forward and rearward ends of the sleeve, and inside of the cylindrical sleeve forming an exterior surface of the sleeve. The second engaging surface 731*b* is therefore formed within an exterior surface of the second part. The tubular member 733 may connect the first filter 722 to the source of smokable material, or may be an additional sheet of material wrapped around the circumference of the tobacco unit.

The restraining means further comprises a raised section 728, being a section of increased diameter, having a step change in diameter from an adjacent rearward section of the tobacco unit. A forward end of the sleeve 723 abuts a rearward facing third engaging surface 728*a* formed by a rearward edge of the raised section 728. The raised section 728 is preferably one or more layers of flexible material, preferably paper, surrounding the first filter and/or tobacco rod. The raised section 728 has an exterior surface which is substantially flush with an exterior surface of the sleeve 723. The raised section 728 prevents forward longitudinal movement of the sleeve 723.

The raised section 728 and third engaging surface 728*a* may be formed by folding outwardly and rearwardly a forward end of the tubular member 733. Alternatively, the raised section 728 may be a separate piece of material affixed to the tubular member 733. The first, second and third engaging surfaces have been described as formed on a folded sheet of flexible material, preferably paper. Alternatively, one or more of the first, second and third engaging surfaces may be formed by a band of material affixed to the first or second part, by embossing, or by any other means to create a raised edge.

FIG. 17 shows an exploded view of the smoking article 720. The smoking article 720 comprises a tobacco unit 721 having a first filter 722 attached to the tobacco rod.

As shown in FIG. 17, the smoking article 720 comprises a control mechanism in the form of an indexing mechanism configured to control rotation between the sleeve 723 and tobacco unit 721. The indexing mechanism comprises a first indexing section 729 on the tobacco unit which is engaged with a second indexing section 730 on the sleeve 723. The sleeve 723 is rotatable relative to the tobacco unit 721 into a plurality of pre-determined indexed rotational positions. Preferably, the first and/or second indexing sections comprise longitudinal grooves and ridges, which are preferably formed by substantially longitudinally extending lines of raised ink or glue. The lines of raised ink form features which are spaced circumferentially and are engagable by a protrusion on the other of the first or second part. The lines of raised ink are on one or both of the exterior of the tobacco unit and an interior of the sleeve.

The ridges of the first indexing section 729 is preferably formed on the tubular member 733 as a blank, prior to forming into a tube, and prior to being affixed to the first filter and/or tobacco rod. The first indexing section 729 preferably extends between the first engaging surface 731*a* and the third engaging surface 728*a*. Both the first and second indexing surfaces may comprise raised lines, or one may comprise any form of protrusion, e.g. a dot of ink or glue or embossing, to engage with the raised lines. The function of the indexing mechanism is the same as described in respect of FIGS. 1 to 5.

Alternatively, the indexing mechanism is configured in a same or similar manner, and performs the same or similar function, as the indexing sections described with respect to FIGS. 1 to 5 or FIGS. 10 to 12. In particular, the first indexing section 729 is a corrugated surface formed in the exterior surface of the filter 722 or on a tubular member attached to the tobacco rod. The indexing surface may be on a separate indexing member as described with respect to FIGS. 1 to 5, affixed to an exterior of the tubular member 733. The first and/or second indexing section may optionally comprise a film overwrap.

The rotational alignment of the first and second parts, as controlled by the indexing sections 729,730, determines the ventilation of the smoking article 720.

The smoking article 720 may comprise a limiting means configured to limit the rotational range of movement of the sleeve. The limiting means comprises a first stop and a second stop, which are circumferentially spaced apart, on one of the first or second parts. The first and second stops are raised above an adjacent surface, and are engagable with a protrusion on the other of the first or second parts to prevent movement of the protrusion beyond the first or second stop. Preferably, the protrusion also provides for indexing by engagement with grooves and ridges in the other part. The first and second stops may be formed by separate pieces of sheet material, e.g. paper, which are affixed, preferably by an adhesive, in a groove of the first or second indexing section.

Alternatively, the first and second stops may be formed by separate tongues of sheet material, e.g. paper, affixed to the first or second indexing section and extending over one or more ridges and/or grooves. The first and second stops may be formed on a single sheet of material, for example, in a C-shape. The protrusion has a range of rotation limited by the opposed sides, e.g. top and bottom of the C-shaped sheet. Alternatively, the first and/or second stops may be formed by a raised dot of glue or a raised dot of ink. Alternatively, the limiting means may comprise one or both of the first or second indexing section extending over only a part of the circumference of the first or second parts. The circumferential edges of the first or second indexing section form stops which inhibit further rotation. A limiting means as described may be present on any of the embodiments having an indexing mechanism to limit the range of rotation.

The smoking article 720 is provided with an indicator for indicating the relative rotation of the sleeve and tobacco unit, and so indicates the ventilation. The indicator comprises at least one marking on the tobacco unit 721 which is visible beyond the sleeve 723. The markings are formed on the raised section 728, and are alignable with a marking on the sleeve. Alignment of the first marking with the marking on the sleeve indicates alignment or non-alignment of the first and second ventilation apertures 726,727.

Figure 18:
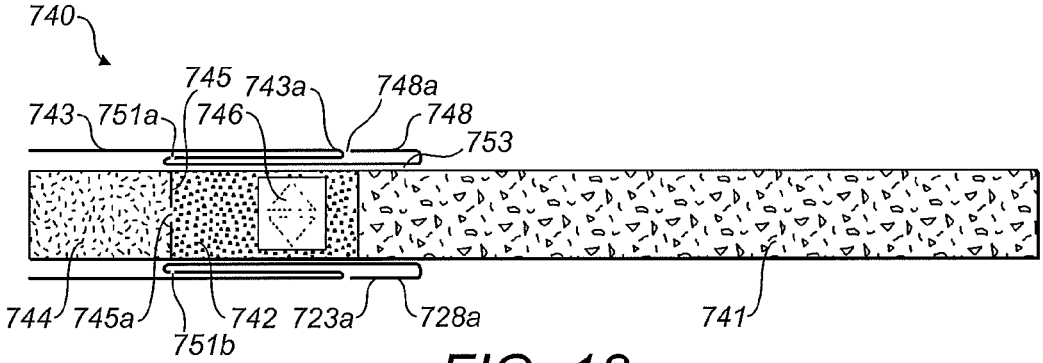
FIG. 18 is a cut-away side elevation view of a smoking article with a sixth embodiment of a variable ventilation system in a first state.
Figure 19:
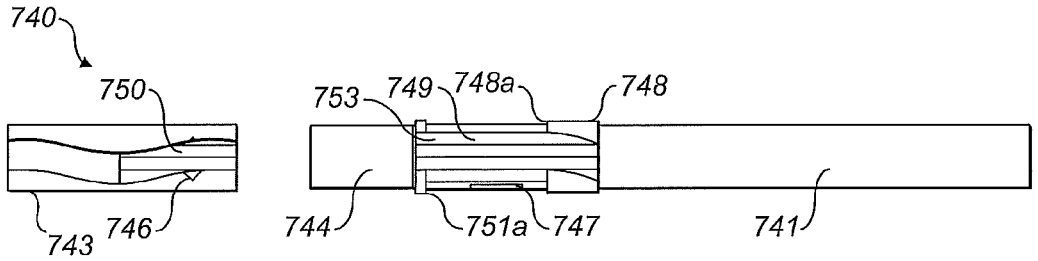
FIG. 19 is an exploded cut-away side elevation view of a smoking article with the sixth embodiment of a variable ventilation system.

FIGS. 18 and 19 show a sixth embodiment of smoking article 740. Smoking article 740 is formed substantially as described in any of the embodiments above. The smoking article 740 comprises a tobacco unit 741, which may comprise a tobacco rod and a first filter 742. A first part comprising the tobacco unit 741 is moveable relative to a second part of the smoking article comprising a sleeve 743. The tobacco unit 741 is adjacent and rotatably connected to a second filter 744. The second filter 744 is fixed to the sleeve 743 and is rotatable relative to the first filter 742 as the first part is rotatable relative to the second part.

The sleeve 743 is rotatable relative to the tobacco unit 741, and the sleeve 743 is not movable longitudinally relative to the tobacco unit 741. The tobacco unit 741 has a rearward end, which is surrounded by the sleeve 743.

The sleeve 743 is provided with one or more first ventilation apertures 746 in the air impermeable material of the sleeve, at one or more circumferential positions. The first ventilation aperture may extend circumferentially over only a part of the circumference. Preferably, the first ventilation apertures comprise a first and second aperture 746 which are circumferentially spaced. The first ventilation aperture(s) 746 are preferably shaped to indicate to a user that the sleeve 743 is rotatable. The first and second ventilation apertures 746 preferably taper in width in a circumferential direction. In particular, the first and second ventilation apertures 746 are each triangular, having their apexes pointing circumferentially in opposite directions.

The tobacco unit 741 is provided with one or more second ventilation apertures 747 in an exterior air impermeable surface at one or more circumferential positions. The second ventilation aperture may extend circumferentially over only a part of the circumference, and preferably, is formed by an array of apertures extending circumferentially and longitudinally. The second ventilation aperture 747 may selectively extend over none, part of one, one or all of the first ventilation apertures.

In the non-ventilating state, the first and second ventilation apertures 746,747 are not aligned. In a ventilating state, the first and second ventilation apertures 746,747 are aligned. The state of ventilation is selected by relative rotation of the sleeve and tobacco unit. The first and second filters 742,744 rotate relative to each other as required to select an overlap or alignment of the first and second ventilation apertures.

The smoking article 740 is configured such that an initial ventilation state can be selected as a minimum ventilation state, a maximum ventilation state or an intermediate ventilation state between the maximum and minimum values, as described with respect to FIGS. 1 to 5.

FIG. 18 shows the smoking article 740 in a ventilating state. The first and second ventilation apertures 746,747 are aligned. The ventilation of the smoking article 740 is variable by relative rotation, without extending the smoking article. The sleeve 743 is freely rotatable relative to tobacco unit 741.

The first and second filters 742,744 are formed as a single integral filter. The first filter 742 is partially separated from the second filter 744 by a lateral cut 745. The cut 745 extends over a radially outer part of the first and second filters 742,744. A radially inner core 745*a* connects the first and second filters 742,744. The central core 745*a* of filtration material maintains the attachment of the first filter to the second filter.

FIG. 18 shows the smoking article 740 in a ventilating state. The first and second filters 742,744 have been rotated relative to each other, with the central core 745*a* twisting around a longitudinal axis. The central core 745*a* maintains the attachment of the first filter to the second filter whilst twisted.

The sleeve 743 is further prevented from longitudinal movement over the tobacco unit by a restraining means. The restraining means comprises a first and second engaging surfaces 751*a*,751*b* preventing rearward movement of the sleeve 743 relative to the tobacco unit 741.

The first engaging surface 751*a* on the tobacco unit is preferably formed on a section of increased diameter, having a step change in diameter from an adjacent forward section of the tobacco unit. The forward facing first engaging surface 751*a* is preferably formed on a tubular member 753 formed from a blank of a sheet material (e.g. paper) wrapped around the tobacco unit. The first engaging surface 751*a* is preferably formed by folding outwardly and forwardly a rearward edge of the tubular member 733, or may be formed by tipping paper or another sheet material wrapped around the tobacco unit or tubular member 753.

The second engaging surface 751*b* is provided within an interior surface of the cylindrical tube forming the sleeve 753. The second engaging surface 751*b* is provided on an inwardly folded section of the sleeve 753, formed by folding inwardly a forward end of the sleeve blank.

The second engaging surface 751*b* is formed between the forward and rearward ends of the sleeve, and inside of the cylindrical sleeve forming an exterior surface of the sleeve. The second engaging surface 751*b* is therefore formed within an exterior surface of the second part. The tubular member 753 may connect the first filter 742 to the source of smokable material, or may be an additional sheet of material wrapped around the circumference of the tobacco unit.

The restraining means further comprises a raised section 748, being a section of increased diameter, having a step change in diameter from an adjacent rearward section of the tobacco unit. A forward end of the sleeve 743 abuts a rearward facing third engaging surface 748*a* formed by a rearward edge of the raised section 748. The raised section 748 is preferably one or more layers of flexible material, preferably paper, surrounding the first filter and/or tobacco rod. The raised section 748 has an exterior surface which is substantially flush with an exterior surface of the sleeve 743. The raised section 748 prevents forward longitudinal movement of the sleeve 743.

The raised section 748 and third engaging surface 748*a* may be formed by folding outwardly and rearwardly a forward end of the tubular member 753. Alternatively, the raised section 748 may be a separate piece of material affixed to the tubular member 753. The first, second and third engaging surfaces have been described as formed on a folded sheet of flexible material, preferably paper. Alternatively, one or more of the first, second and third engaging surfaces may be formed by a band of material affixed to the first or second part, by embossing, or by any other means to create a raised edge.

FIG. 19 shows an exploded view of the smoking article 740. The smoking article 740 comprises a tobacco unit 741 having a first filter 742 attached to the tobacco rod. As shown in FIG. 19, the smoking article 740 comprises a control mechanism in the form of an indexing mechanism configured to control rotation between the sleeve 743 and tobacco unit 741. The indexing mechanism comprises a first indexing section 749 on the tobacco unit which is engaged with a second indexing section 750 on the sleeve 743. The sleeve 743 is rotatable relative to the tobacco unit 741 into a plurality of pre-determined indexed rotational positions. Preferably, of the first and or second indexing sections comprise longitudinal grooves and ridges, which are preferably formed by substantially longitudinally extending lines of raised ink or glue. The lines of raised ink or glue form features which are spaced circumferentially and are engagable by a protrusion on the other of the first or second part, as described with respect to FIGS. 16 to 18. The lines of raised ink are on one or both of the exterior of the tobacco unit and an interior of the sleeve. The ridges of the first indexing section 749 are preferably formed on the tubular member 753 as a blank, prior to forming into a tube, and prior to being affixed to the first filter and/or tobacco rod. The first indexing section 749 preferably extends between the first engaging surface 751*a* and the third engaging surface 748*a*. Both the first and second indexing surfaces may comprise raised lines, or one may comprise any form of protrusion, e.g. a dot of ink or glue or embossing, to engage with the raised lines. The function of the indexing mechanism is the same as described in respect of FIGS. 1 to 5.

Alternatively, the indexing mechanism is configured in a same or similar manner, and performs the same or similar function, as the indexing sections described with respect to FIGS. 1 to 5 or FIGS. 10 to 12. In particular, the first indexing section 749 is on a tubular member attached to the first filter and/or tobacco rod, or a corrugated surface formed in the exterior surface of the filter 742. The indexing surface may be on a separate indexing member as described with respect to FIGS. 1 to 5, affixed to an exterior of the tubular member 753. The first and/or second indexing section may optionally comprise a film overwrap.

The smoking article 740 may comprise a limiting means configured to limit the rotational range of movement of the sleeve. The limiting means comprises a first stop and a second stop, which are circumferentially spaced apart, on one of the first or second parts. The first and second stops raised above the adjacent surface, and are engagable with a protrusion on the other of the first or second parts to prevent movement of the protrusion beyond the first or second stop. Preferably, the protrusion also provides for indexing by engagement with grooves and ridges in the other part. The first and second stops may be formed by separate pieces of sheet material, e.g. paper, which is affixed, preferably by an adhesive, in a groove of the first or second indexing section. Alternatively, the first and second stops may be formed by separate tongues of sheet material, e.g. paper, affixed to the first or second indexing section and extending over one or more ridges and grooves. The first and second stops may be formed on a single sheet of material, for example, in a C-shape. The protrusion has a range of rotation limited by the opposed sides, e.g. top and bottom of the C-shaped sheet. Alternatively, the first and/or second stops may be formed by a raised dot of glue or a raised dot of ink. Alternatively, the limiting means may comprise one or both of the first or second indexing section extending over only a part of the circumference of the first or second parts. The circumferential edges of the first or second indexing section form stops which inhibit further rotation.

The rotational alignment of the first and second parts, as controlled by the indexing sections 749,750, determines the ventilation of the smoking article 740.

The smoking article 740 is provided with an indicator for indicating the relative rotation of the sleeve and tobacco unit, and so indicates the ventilation. The indicator comprises at least one marking on the tobacco unit 741 which is visible beyond the sleeve 743. The markings are formed on the raised section 748, and are alignable with a marking on the sleeve. Alignment of the first marking with the marking on the sleeve indicates alignment or non-alignment of the first and second ventilation apertures 746,747.

Figure 20:
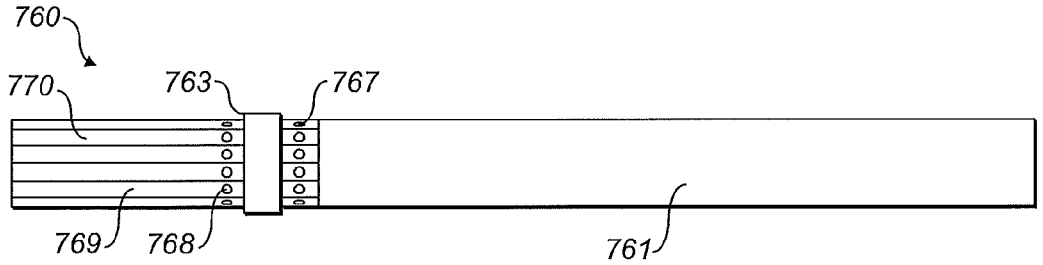
FIG. 20 is a side elevation view of a smoking article with a seventh embodiment of a variable ventilation system in a first state.
Figure 21:
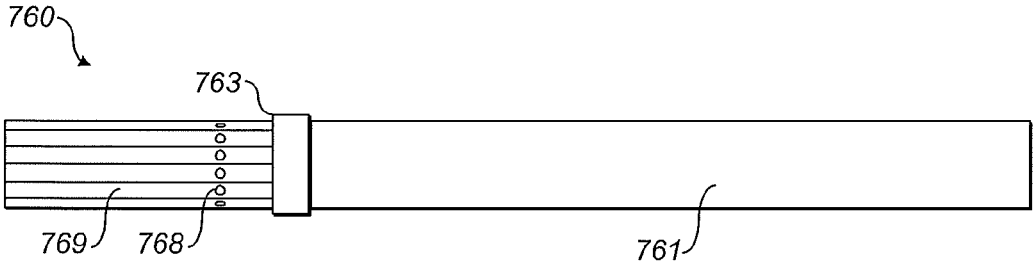
FIG. 21 is a side elevation view of a smoking article with the seventh embodiment of a variable ventilation system in a second state.

FIGS. 20 and 21 show a seventh embodiment of smoking article 760. Smoking article 760 is formed substantially as described in any of the embodiments above. The smoking article 760 comprises a tobacco unit 761, which may comprise a tobacco rod and a filter. A first part comprising the tobacco unit 761 is moveable relative to a second part of the smoking article comprising a sleeve 763. The sleeve 763 is slidable in a longitudinal direction relative to the tobacco unit 761. The sleeve 763 is not movable rotationally relative to the tobacco unit 761. The tobacco unit 761 has a rearward end, which is circumscribed by the sleeve 763.

The tobacco unit 761 comprises one or more ventilation apertures 767 adjacent to a rearward end. Preferably, the tobacco unit 761 comprises a plurality of ventilation apertures 767 in a row extending circumferentially. The ventilation apertures 767 allow ingress of air through an air impermeable outer surface into tobacco unit 761, in particular into the filter and/or into the tobacco rod containing a source of smokable material. The ventilation apertures 767 are formed in a first guide section 769 over which the sleeve 763 can be moved longitudinally.

The sleeve 763 is an annular tubular ring slidable longitudinally over first guide section 769 of the tobacco rod. The sleeve 763 is formed of an air-impermeable material, preferably paper.

The guide section 769 of the tobacco rod comprises restraining means to limit the longitudinal travel of the sleeve 763. Preferably, the restraining means comprises one or more protrusions 768 extending radially outwardly from the tobacco rod. The protrusions 768 may be formed from or glue ink forming a raised dot. The protrusions 768 limit rearward travel of the sleeve 763. Each protrusion 768 may be circumferentially aligned with a ventilation aperture 767. The restraining means is arranged such that the sleeve 763 can move between a first position covering the ventilation apertures 767, and a second position in which the ventilation apertures 767 are not covered.

The restraining means may further comprise means to limit longitudinal travel of the sleeve in a forward direction. At least a part of the exterior surface of the tobacco unit 761, forward of first guide section 769, extends radially outwardly of at least a part of the section 769, as will be described in more detail below.

FIG. 20 shows the smoking article in a ventilating state, in which the sleeve is in the second position. The sleeve 763 is rearwardly of the ventilation apertures 767, allowing ingress of air into the smoking article.

FIG. 21 shows the smoking article in a non-ventilating state, in which the sleeve is in the first position. The sleeve 763 is covering the ventilation apertures 767, preventing ingress of air into the smoking article through the ventilation apertures 767.

As shown in FIGS. 20 and 21, the smoking article 760 comprises a control mechanism in the form of a guide mechanism configured to control rotation between the sleeve 763 and tobacco unit 761. In particular, the guide mechanism allows longitudinal movement of sleeve 763 and prevents any rotation between the sleeve 763 and tobacco unit 761.

The guide mechanism has a similar form as the indexing mechanism described with respect to FIGS. 1 to 5, with the guide mechanism configured to inhibit rotation, e.g. by having a greater depth and/or rigidity than the indexing mechanism. The guide mechanism comprises the first guide section 769 on the tobacco unit which is engaged with a second guide section on the sleeve 763. The first guide section 769 and second guide section preferably have the same shape, configuration and construction as the first and second indexing surfaces described with respect to FIGS. 1 to 5. The sleeve 763 is configured to not rotate relative to the tobacco unit 761. The tobacco unit 761 comprises the first guide section 769 at its rearward end, and surrounded by the sleeve 763. The first guide section 769 preferably has a corrugated exterior surface. In particular, the first guide section 769 has an outer surface which is not smooth, and preferably comprises a plurality of ridges and grooves extending longitudinally. The second filter 764 is located within the first guide section 769. In particular, the plurality of ridges and grooves define a sinuous outer surface, which smoothly oscillates in radius.

The first guide section may be formed on any exterior surface of the first part of the smoking article. In particular, the first guide section 769 may be formed on a tubular guide member 770 surrounding the filter. The tubular guide member 770 surrounding the filter is separate to the filtration material and plugwrap forming the filter, and may optionally connect the filter to the tobacco rod. The tubular guide member 770 defining the first guide section 769 may be a tubular cellulose acetate or paper sleeve having depressions and/or protrusions as described above, and may be attached to the filter by an adhesive. The features of the first guide section 769 are formed when the sleeve is a blank prior to forming a sleeve, and prior to attachment of the sleeve to the filter and/or tobacco rod, substantially as described with respect to FIGS. 1 to 5.

The guide grooves and ridges preferably extend around the whole circumference of the tobacco unit, or alternatively, extend around only a part of the circumference of the tobacco unit.

Alternatively, the first guide section 769 is formed in a radially facing curved exterior surface of the filter. The filter having an exterior surface with the guide section comprises filtration material, preferably formed in a cylinder extending longitudinally. The filtration material is any known filtration material, and in particular, is formed of cellulose acetate tow. The filtration material is wrapped in one or more sheets of flexible material. Preferably, the flexible material is paper, and may be known as plugwrap. The paper extends around the curved sides of the cylinder of filtration material. The paper forms, or supports, a continuous outer surface defining the grooves and ridges of the first guide section. The paper is deformed to form the grooves and ridges, and treated such that the shape of the grooves and ridges are permanently maintained in the paper. The paper is shaped to define grooves and ridges before it is wrapped around the filtration material. The paper plugwrap is not cut to define the grooves. The paper may be deformed by embossing, extrusion, crimping or applying any form of pressure, in particular using rollers. The paper may be heated during formation of the depressions.

The first and/or second guide section is optionally overwrapped by a film. The film provides a continuous exterior surface defining the plurality of grooves. The film is preferably a plastics material, for example, in particular a polymer, for example, polypropylene. The film may be transparent, or may be opaque. The plastics film provides an exterior surface which is more rigid than the grooves and ridges formed in the paper and filtration material. The film inhibits the grooves and ridges being smoothed out by contact with the engaging part of the guide mechanism.

The sleeve 763 comprises a second guide section 768*b*. The second guide section (not shown) is located on the interior of the sleeve 763, at the rearward end, and preferably has a corrugated inner surface. In particular, the second guide section has an inner surface which is not smooth, and preferably comprises a plurality of ridges and grooves extending longitudinally. In particular, the plurality of ridges and grooves define a sinuous outer surface, which smoothly oscillates in radius.

The second guide section may be formed by a sheet of flexible material, e.g. paper, which is corrugated and affixed to an inner surface of the sleeve 763. Preferably, the second guide section has substantially the same, or similar, configuration and shape to the first guide section 769. The second guide section defines a plurality of ridges, between the grooves, which are engagable with the first guide section. Alternatively, the first and second guide sections 769 may engage with different configurations. In particular, the second guide section may comprise one or more discrete protrusion extending radially inwardly from the interior of the sleeve 763. The protrusion is configured to engage in the grooves of the first guide section 769 to control rotation. The protrusion may be formed by a dot of raised ink, by embossing, or by any other suitable means to engage with the first guide section.

The guide mechanism has grooves, ridges, protrusions or other features which are dimensioned or made of materials such that rotation between the first and second parts of the smoking article is inhibited. In particular, the guide mechanism is configured such that the features are not resiliently deformable to allow indexed rotation with application of a reasonable force, as is the indexing mechanism of the other embodiments. The guide mechanism is configured such the sleeve can slide freely around the tobacco unit to vary ventilation, without rotation.

The exterior surface of the tobacco unit forward of section 769 has a substantially constant radius, i.e. does not have grooves formed in it. The exterior surface is radially aligned with the ridges of section 769. The corrugated section 110 of sleeve 763 is configured to engage in the grooves, which are lower than the ridges. Therefore, forward movement of the sleeve is limited by engagement of the inward extremities of the sleeve 763 with the upstanding edge of the exterior surface of the tobacco unit at a forward end of the grooves.

Figure 22:
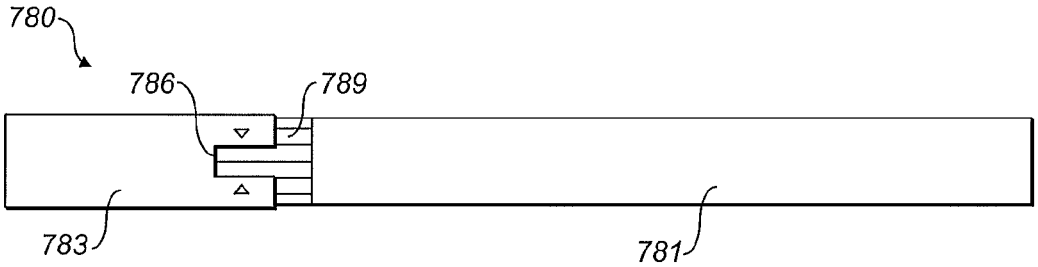
FIG. 22 is a side elevation view of a smoking article with an eighth embodiment of a variable ventilation system in a first state.
Figure 23:
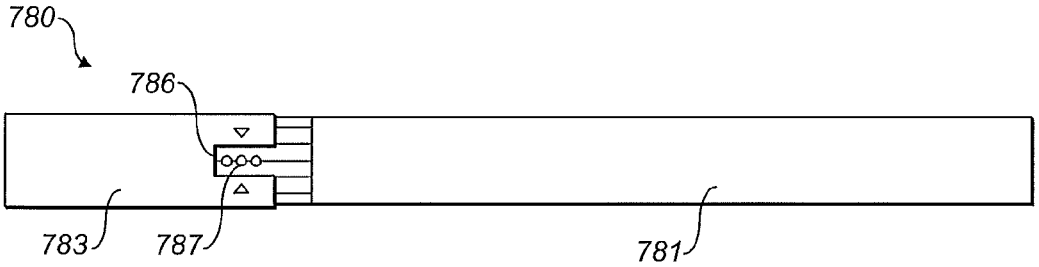
FIG. 23 is a side elevation view of a smoking article with the eighth embodiment of a variable ventilation system in a second state.
Figure 24:
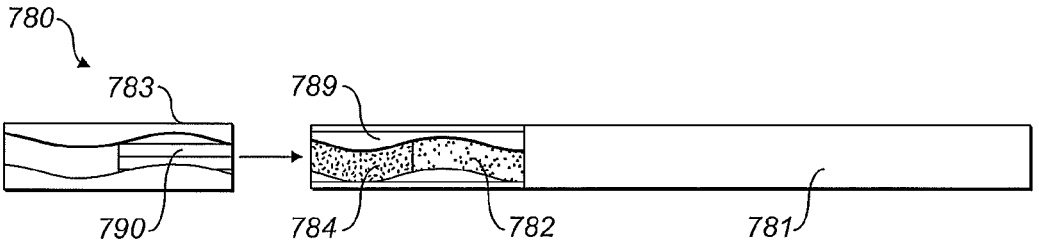
FIG. 24 is an exploded cut-away side elevation view of a smoking article with the eighth embodiment of a variable ventilation system.

FIGS. 22 to 24 show an eighth embodiment of smoking article 780. Smoking article 780 is formed substantially as described in any of the embodiments above. The smoking article 780 comprises a tobacco unit 781, which may comprise a tobacco rod and a first filter 782. A first part comprising the tobacco unit 781 is moveable relative to a second part of the smoking article comprising a sleeve 783. The tobacco unit 781 is adjacent to a second filter 784. The second filter 784 is located rearwardly of, and abutting, the separate first filter 782. The second filter 784 preferably does not rotate relative to the first filter 782 as the first part is rotated relative to the second part.

The sleeve 783 is rotatable relative to the tobacco unit 781, and the sleeve 783 is not movable longitudinally relative to the tobacco unit 781. The tobacco unit 781 has a rearward end, which is surrounded by the sleeve 783. The sleeve 783 is formed of an air impermeable material, preferably paper.

The sleeve 783 is provided with one or more ventilation cut-outs 786 at one or more circumferential positions. The ventilation cut-out may extend circumferentially over only a part of the circumference, and preferably, is one or more apertures. Preferably, the ventilation cut-out comprises a single cut-out which is open to a forward end of the tubular sleeve 783.

The tobacco unit 781 is provided with one or more ventilation apertures 787 at one or more circumferential positions. The second ventilation apertures may extend circumferentially over only a part of the circumference, and preferably, is formed by one or more apertures extending longitudinally at a single circumferential position. Preferably, the ventilation apertures are spaced apart in a single longitudinally extending row. The second ventilation apertures 787 may substantially either fully aligned or not aligned with the ventilation cut-out 786 of the sleeve.

FIG. 22 shows the smoking article 780 in the non-ventilating state, in which the ventilation cut-out 786 and ventilation apertures 787 are not aligned. The impermeable material of the sleeve 783 covers and prevents flow of air to the ventilation apertures 787. The state of ventilation is selected by relative rotation of the sleeve and tobacco unit. The sleeve is rotatable around the tobacco unit to select the ventilation.

FIG. 23 shows the smoking article 780 in a ventilating state. The ventilation cut-out 786 and ventilation apertures 787 are aligned, allowing flow of air into the first filter. The sleeve 783 may be prevented from longitudinal movement by a restraining means (not shown). The restraining means may be formed by engaging surfaces, for example, as described with respect to FIGS. 1 to 5. Alternatively, the first and second filters may be integrally formed, and connected by a central core of filtration material, substantially as described with respect to FIGS. 10 to 12. The central core of filtration functions as a restraining means, preventing separation of the first and second parts of the smoking article. Alternatively, the smoking article may not comprise a restraining means.

FIG. 24 shows an exploded view of the smoking article 780. The smoking article 780 comprises a tobacco unit 781 having a first filter 782 attached to the tobacco rod. The second filter may be attached to the first filter 782, or may be attached to the sleeve 783.

As shown in FIGS. 22 to 24, the smoking article 780 comprises a control mechanism in the form of an indexing mechanism configured to control rotation between the sleeve 783 and tobacco unit 781. The indexing mechanism comprises a first indexing section 789 on the tobacco unit which is engaged with a second indexing section 790 on the sleeve 783. The sleeve 783 is rotatable relative to the tobacco unit 781 into a plurality of pre-determined indexed rotational positions. The indexing mechanism is configured in substantially the same or similar manner, and performs the same or similar function, as the first and second indexing sections described with respect to FIGS. 1 to 5. In particular, the first indexing section 789 is a corrugated surface formed in a tubular member surrounding the filters, or on the exterior surface of the first and/or second filter 782,784. The first and/or second indexing section may comprise a film overwrap. The rotational alignment of the first and second parts, as controlled by the indexing sections 789,710, determines the ventilation of the smoking article 780.

Figure 25:
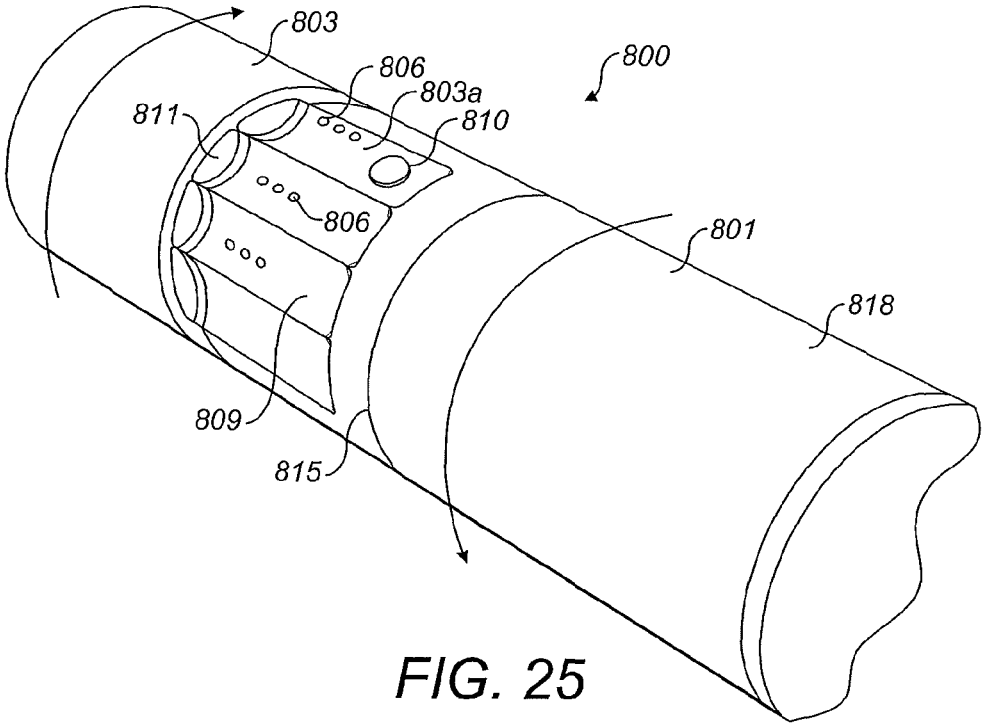
FIG. 25 is a perspective view of a smoking article with a ninth embodiment of a variable ventilation system in a first state.
Figure 26:
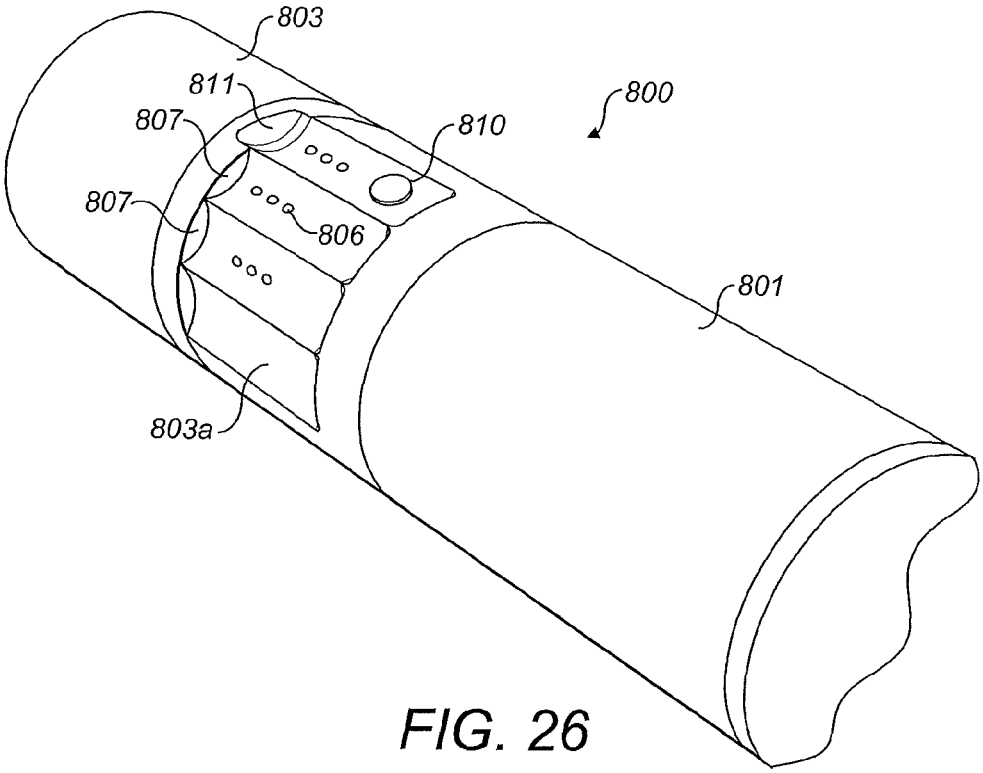
FIG. 26 is a perspective view of a smoking article with the ninth embodiment of a variable ventilation system in a second state.

FIGS. 25 and 26 show a ninth embodiment of smoking article 800. Smoking article 800 is formed substantially as described in any of the embodiments above. The smoking article 800 comprises a tobacco unit 801, which may comprise a tobacco rod and a first filter. A first part comprising the tobacco unit 801 is moveable relative to a second part of the smoking article comprising a sleeve 803. The tobacco unit 801 is adjacent, and rotatably connected to, a second filter. The sleeve 803 is rotatable relative to the tobacco unit 801, and the sleeve 803 is not movable longitudinally relative to the tobacco unit 801. The tobacco unit 801 has a rearward end, which is surrounded by a forward section 803*a* the sleeve 803. The forward section 803*a* of the sleeve 803 is not directly attached to the underlying tobacco unit in use, and so can rotate relative to the tobacco unit.

The forward section 803*a* of the sleeve 803 is provided with one or more first ventilation apertures 806 at one or more circumferential positions. The first ventilation apertures are preferably located at discrete circumferential locations over only a part of the circumference, and preferably, the or each circumferential location comprises a plurality of apertures 806 in a longitudinally extending row. The forward section 803*a* of the sleeve 803 may be transparent, as shown, to reveal the underlying structure of the smoking article. Alternatively, the forward section 803*a* of the sleeve 803 may be opaque.

The tobacco unit 801 is provided with one or more second ventilation apertures 807 at one or more circumferential positions. The second ventilation apertures 807 may extend circumferentially over only a part of the circumference, and preferably, are formed in a forward facing surface of the smoking article within sleeve 803. The first and second ventilation apertures 806,807 co-operate to allow flow of air into the smoking article without being directly aligned. The first and second ventilation apertures 806,807 may be circumferentially aligned to form spaced apart openings onto a ventilation passage, which will be described in more detail below. Alternatively, the second ventilation apertures may be located directly underneath the first ventilation apertures in order to allow ventilation, in a radially facing surface.

The smoking article 800 comprises a control mechanism in the form of an indexing mechanism configured to control rotation between the sleeve 803 and tobacco unit 801. The indexing mechanism comprises a first indexing section 809 on the tobacco unit which is engaged with a second indexing section 810 on the sleeve 803. The sleeve 803 is rotatable relative to the tobacco unit 801 into a plurality of predetermined indexed rotational positions. The indexed positions are narrowly spaced, providing for incremental stepwise movement. The indexing mechanism of the present invention provides an angle of rotation which may be finely controlled and maintained. The indexing mechanism provides a large number of indexed positions, at least three, preferably at least seven, and more preferably 8, 10, or 12, 15, 20, 22 or more. The index mechanism provides for a substantially continuous rotation between the first part and second part.

The tobacco unit 801 comprises the first indexing section 809 at its rearward end, and surrounded by the sleeve 803. The first indexing section 809 defines a plurality of depressions, and preferably has a corrugated exterior surface. In particular, the first indexing section 809 has an outer surface which is not smooth, and preferably comprises a plurality of ridges and grooves extending longitudinally. The first filter is located within the first indexing section 809. The indexing mechanism is configured in substantially the same or similar manner, and performs the same or similar function, as the first and second indexing sections described with respect to FIGS. 1 to 5. In particular, the plurality of ridges and grooves define a series of concave rounded grooves having a pointed ridge between them, as described with respect to FIGS. 1 to 5. Alternatively, the grooves and ridges define a sinuous outer surface which smoothly oscillates in radius.

The first indexing section 809 is formed on a tubular member e.g. of cellulose acetate or paper surrounding the first filter and/or tobacco rod, or in a radially facing curved exterior surface of the first filter, as described with respect to FIGS. 1 to 5. The indexing grooves and ridges preferably extend around the whole circumference of the tobacco unit, or alternatively, extend around only a part of the circumference of the tobacco unit.

The sleeve 803 comprises a second indexing section 810 located on an interior surface of the forward section 803*a*. The second indexing section 810 is preferably is one or more protrusions extending radially inwardly. The protrusions are preferably formed from ink or glue, preferably as dot of raised ink or glue. The protrusion resiliently engages in a groove of the first indexing section, inhibiting further rotation until sufficient force is applied. Alternatively, the second indexing section may comprise a corrugated inner surface having a plurality of ridges and grooves extending longitudinally, an embossed section, or any feature to engage with the first indexing section.

Rotation of the sleeve 803 may be accompanied with an audible sound, e.g. a click, at each pre-determined position. The indexing mechanism functions to resist rotation between the first and second parts of the smoking article, unless sufficient force is applied and the parts rotate to the next indexed position. The indexing mechanism provides feedback to a user that the first and second parts have been rotated, preferably in the form of touch in the indexing movement and/or sound as each indexing position is engaged. The indexing mechanism does not limit rotation to a predefined range of rotation.

The second ventilation apertures 807 are spaced longitudinally from the first ventilation apertures, and are preferably located at or adjacent a rearward end of only some of the grooves. Preferably, second ventilation apertures 807 are located at approximately half of the grooves. The second ventilation apertures 807 may extend radially between a bottom of the grooves and a top of the grooves, substantially level with the ridges between grooves. The second ventilation apertures 807 function separately for each groove, although may be formed as one or more apertures extending over one or more grooves. The tobacco unit 801 comprises an air impermeable material at a closed rearward end 811 of at least one of the grooves. The closed rearward end 811 does not allow air flow into the body of the smoking article, in particular, the second filter. The selection of air flow into a groove having either a second ventilation aperture 807 or a closed rearward end 811 provides for selection of ventilation. The closed rearward end 811 is defined by a groove formed in the tubular member, or plugwrap defining the exterior surface of the first filter, which does not extend to the rearward end of the member or plugwrap and does not break or cut through the non-permeable material of the member or plugwrap. Alternatively, the closed rearward end 811 may be formed where an annular section of material extends radially inwardly to cover an end of the groove, and the second ventilation apertures 807 are formed where an annular section of material does not extend radially inwardly. Alternatively, the closed rearward ends 811 and second ventilation apertures 807 may be formed in a ring having a radial extent and located rearwardly of the grooves.

The grooves of the first indexing section 809 define ventilation passages which extend longitudinally. The ridges between adjacent grooves are substantially in contact with the surrounding sleeve 803. Each of the first ventilation apertures 806 allows air into a single groove 809. Thus, air flow in each groove of the first indexing section 809 is substantially isolated from the other grooves. The air can flow longitudinally along the groove in a rearward direction. If a second ventilation aperture 807 is at a rearward end of that groove, then the air can continue to flow into the interior of the smoking article, within the sleeve 803 and into the second filter. If the groove is not aligned with a second ventilation aperture 807 then the air is prevented from flowing into the interior of the smoking article, and ventilation is inhibited.

The rotational alignment of the first and second parts, as controlled by the indexing sections 809,810, determines the ventilation of the smoking article 800. Ventilation is provided when the first and second ventilation apertures 806, 807 are circumferentially aligned, although the first and second ventilation apertures 806,807 are connected by a ventilation passage and do not directly overlap. Preferably, the smoking article 800 comprises a plurality of first ventilation apertures 806 and a plurality of second ventilation apertures 807. The number of first and second ventilation apertures 806,807 aligned provides a plurality of ventilating states having different levels of ventilation, in addition to a non-ventilating state when none of the first and second ventilation apertures 806,807 are aligned.

The grooves of the first indexing section 809 have a dual function. The grooves 809 engage with the second indexing section to provide a rotational indexing of the first and second parts of the smoking article, controlling rotation and providing feedback when the parts are rotated. The grooves 809 also function as ventilation passages, connecting the first and second ventilation apertures 806,807 to allow flow of air into the smoking article.

The first and second filters are formed as a single integral filter. The first filter is partially separated from the second filter by a lateral cut. The cut extends over a radially outer part of the first and second filters. A radially inner core connects the first and second filters. The central core of filtration material maintains the attachment of the first filter to the second filter. The first part can rotate relative to the second part can whilst connected by the central filter core. The connected first and second filters are described in more detail and shown with respect to FIGS. 10 to 12. Alternatively, the first and second filters may be separate filters, or a single filter which is connected only to the tobacco unit and not to the sleeve. A further restraining means, for example as described in any other embodiment, may connect the first and second parts of the smoking article.

FIG. 25 shows the smoking article 800 in a non-ventilating state. Air can flow into selected grooves through the first ventilation apertures 806. The selected grooves each have a closed rearward end 811, and do not have an aligned second ventilation aperture, and so ventilating air does not enter the smoking article.

FIG. 26 shows the smoking article 8*oo* in a partially ventilating state. The first and second filters have been rotated relative to each other, with the central core twisting around a longitudinal axis. One of the sets of first apertures 806 is aligned with a groove having a second ventilation aperture 807, allowing air into the smoking article rearwardly of the grooves and first and second ventilation apertures 806,807. Further sets of first apertures 806 are aligned with grooves having a closed rearward end 811 instead of a second ventilation aperture 807, preventing ingress of air into the smoking article.

The tobacco unit 801 may have a section 818 adjacent to the sleeve 803, and having an exterior surface which is flush with an exterior surface of the sleeve 803. The sleeve 803 and section 818 may initially be integrally formed, preferably from a single sheet of flexible material, e.g. paper or tipping paper. The sleeve 803 and section 818 may be separable along a separation line 815, which may form a frangible connection by perforations along line 815. Initial relative rotation between the sleeve 803 and section 818 or any part of the tobacco unit 801 breaks the connection between the sleeve 803 and section 818, allowing indexed rotation between the first and second parts. Alternatively, sleeve 803 and section 818 may be initially formed as separate sections.

The smoking article 800 is configured such that an initial ventilation state can be selected as a minimum ventilation state, a maximum ventilation state or an intermediate ventilation state between the maximum and minimum values, as described with respect to FIGS. 1 to 5.

Figure 27:
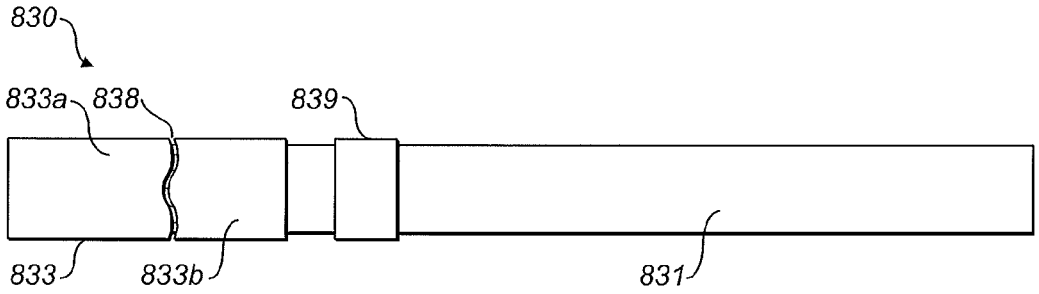
FIG. 27 is a side elevation view of a smoking article with a tenth embodiment of a variable ventilation system in a first state.
Figure 28:
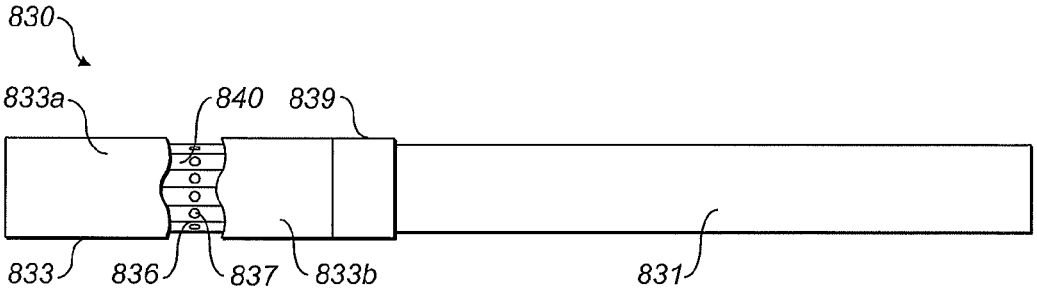
FIG. 28 is a side elevation view of a smoking article with the tenth embodiment of a variable ventilation system in a second state.

FIGS. 27 and 28 show a tenth embodiment of smoking article 830. Smoking article 830 is formed substantially as described in any of the embodiments above. The smoking article 830 comprises a tobacco unit 831, which may comprise a tobacco rod and a filter. A first part comprising the tobacco unit 831 is moveable relative to a second part of the smoking article comprising a sleeve 833. At least a part of the sleeve 833 is slidable in a longitudinal direction around the tobacco unit 831. The sleeve 833 is not movable rotationally relative to the tobacco unit 831. The sleeve 833 is a cylindrical tube which circumscribes the tobacco unit adjacent a rearward end of the tobacco unit 831.

The sleeve 833 is formed of two parts: a rearward section 833*a*, and a forward section 833*b* co-axially aligned with the rearward section 833*a*. The two sections 833*a*,833*b* are initially connected by a circumferentially extending frangible, or breakable, connection 838. The forward section and rearward section may be formed as a single piece, and the frangible connection formed by perforations. Alternatively, the two parts 833*a*,833*b* of the sleeve may abut, and not be connected initially.

One or both of the rearward section 833*a* and the forward section 833*b* are slidable longitudinally around the tobacco unit. Preferably, the rearward section 833*a* is fixed in position and the forward section 833*b* is slidable forwardly and rearwardly around the tobacco unit. The rearward section 833*a* functions as a rearward stop section, limiting rearward movement of the slidable section 833*b*. The first part of the smoking article comprises the fixed section 833*a* of the sleeve, and the second part of the smoking article comprises the or each movable section 833*b* of the sleeve. At least the movable forward section 833*a* of the sleeve 833 is formed of an air-impermeable material, preferably paper.

FIG. 27 shows the smoking article in a relatively low ventilation state, in which the sleeve 833*b* is in a first, rearward, position. The sleeve 833*b* covers ventilation apertures in the tobacco unit, preventing ingress of air into the filter of the smoking article through the ventilation apertures.

FIG. 28 shows the smoking article 830 in a relatively high ventilation state. The two sections of the sleeve 833 are separated longitudinally to define a first ventilation aperture 836 between the two facing edges of the sections 833*a*,833*b* of the sleeve.

The tobacco unit 831 comprises one or more second ventilation apertures 837 adjacent to a rearward end. Preferably, the tobacco unit 831 comprises a plurality of second ventilation apertures 837 in a line extending circumferentially. Preferably, the plurality of second ventilation apertures 837 are in an air impermeable paper wrap forming an exterior surface of the tobacco unit, in particular, the filter.

The rearward section 833*a* and forward section 833*b* are separable to uncover the one or more second ventilation apertures 837. The second ventilation apertures 837 allow ingress of air into the tobacco unit 831 when uncovered, i.e. aligned with the first ventilation aperture 836 when the forward section of sleeve 833 is moved forwardly. The ventilation apertures 837 are formed on a first guide section 840 over which the sleeve 833*b* can be moved longitudinally.

The forward section and rearward section 833*a*, 833*b* of the sleeve have profiled edges facing each other which are interlocking. The interlocking of the profiled edges requires one or more particular rotational positions of the forward section relative to the rearward section. Preferably, the profiled edges are complementary, and extend substantially circumferentially with a continuously undulating, or sinuous, profile in the longitudinal direction. The profiled edges of the forward section and rearward section are aligned and have the same circumferential profile, such that a longitudinal distance between the facing edges is constant around the circumference of the sleeve 833. The profiled edges define first and second engaging surfaces of a restraining means configured to limit rearward longitudinal movement of the forward section 833*b*.

The smoking article 830 comprises a control mechanism in the form of a guide mechanism configured to control rotation between a movable section of the sleeve 833 and tobacco unit 831. In particular, the guide mechanism prevents any rotation between the slidable section of the sleeve 833*b* and tobacco unit 831. The guide mechanism comprises a first guide section 840 on an exterior surface of the tobacco unit which is engaged with a second guide section on an interior surface of the slidable section of the sleeve 833, i.e. forward section 833*b*. The forward section 833*b* of the sleeve is configured to be fixed rotationally relative to the tobacco unit 831. The tobacco unit 831 comprises the first guide section 840 adjacent its rearward end, forwardly of the sleeve section 833*a* and surrounded by the sleeve 833*b*.

The first guide section 840 preferably comprises a plurality of longitudinally extending grooves or ridges underneath the forward section of the sleeve. The ridges are preferably formed by the application of lines of raised ink or glue extending longitudinally, and spaced apart to define grooves between the lines. The second guide section preferably comprises one or more protrusions on an interior surface of the slidable section of the sleeve 833. The one or more protrusions may be formed by one or more dots or ink or glue. Alternatively, the protrusions may be formed by embossing. The one or more protrusions are configured to engage with the raised lines, such that the protrusions cannot rotate over the raised lines and hence rotation is prevented.

Alternatively, the guide mechanism has a similar form to the indexing mechanism described with respect to FIGS. 1 to 5, with the guide mechanism configured to inhibit rotation as described with respect to FIGS. 20 and 21. The first guide section 840 preferably has a corrugated exterior surface. In particular, the first guide section 840 has an outer surface which is not smooth, and preferably comprises a plurality of ridges and grooves extending longitudinally. The filter and/or tobacco rod is located within the first guide section 840. In particular, the plurality of ridges and grooves define a sinuous outer surface, which smoothly oscillates in radius. The grooves and ridges may be formed on a tubular member, e.g. of cellulose acetate or paper, around the filter and/or tobacco rod.

The first guide section is formed in a radially facing curved exterior surface of the tobacco unit, and preferably, the filter. The guide grooves and ridges preferably extend around the whole circumference of the tobacco unit, or alternatively, extend around only a part of the circumference of the tobacco unit.

Alternatively, the first guide section 840 may be formed on an exterior surface of the filter. The first guide section comprises filtration material, preferably formed in a cylinder extending longitudinally. The filtration material is any known filtration material, and in particular, is formed of cellulose acetate tow. The filtration material is wrapped in one or more sheets of flexible material. Preferably, the flexible material is paper, and may be known as plugwrap. The paper extends around the curved sides of the cylinder of filtration material. The paper forms a continuous outer surface defining the grooves and ridges of the first index section. The paper is deformed to form the grooves and ridges prior to being wrapped around the filtration material, and treated such that the shape of the grooves and ridges are permanently maintained in the paper. The grooves and ridges are preferably formed by rollers, and the paper is not cut to define the grooves. The paper wrapping the filtration material is optionally overwrapped by a film, as described above.

The second guide section (not shown) is located on the interior of the slidable section of the sleeve 833. The second guide section has an inner surface which is not smooth, and preferably comprises a plurality of ridges and grooves extending longitudinally. In particular, the second guide section is preferably defined by lines of raised ink or glue, similarly to the first guide section. Alternatively, the second guide section may be a corrugated inner surface In particular, the plurality of ridges and grooves define a sinuous outer surface, which smoothly oscillates in radius.

The second guide section may be formed by a sheet of flexible material, e.g. cellulose acetate or paper, which is corrugated and affixed to an inner surface of the sleeve 833. Preferably, the second guide section has substantially the same, or similar, configuration and shape to the first guide section 840. The second guide section defines a plurality of ridges, between the grooves, which are engagable with the first guide section. Alternatively, the first and second guide sections 840 may engage with different configurations. In particular, the second guide section may comprise one or more discrete protrusion extending radially inwardly from the interior of the forward section of sleeve 833*b*. The protrusion is configured to engage in the grooves of the first guide section 840 to control rotation. The protrusion may be formed by a dot of raised ink or glue, by embossing, or by any other suitable means to engage with the first guide section.

The guide mechanism has grooves, ridges, protrusions or other features which are dimensioned or made of materials such that rotation between the first and second parts of the smoking article is inhibited. In particular, the guide mechanism is configured such that the features are not resiliently deformable to allow indexed rotation with application of a reasonable force, as is the indexing mechanism of other embodiments. The guide mechanism is configured such that the sleeve can slide freely around the tobacco unit to vary ventilation, without rotation.

The longitudinally extending grooves or ridges form corrugations which prevent rotation of the slidable forward section of the sleeve. The means for preventing rotation is preferably present in conjunction with the embodiment described above in which a sections of the sleeve have facing edges with an interlocking profile which requires a particular rotational position. Since the forward section 833*b* cannot rotate, the forward section is always in the correct rotational position to interlock with the rearward section when urged rearwardly. The means for preventing rotation ensures that the movable section of sleeve returns to its original position, in which the undulating profiled edges are complementary.

Preferably, the rearward section 833*a* of the outer sleeve is permanently fixed to the tobacco unit, and limits rearward movement of the forward section 833*b*. The forward section 833*b* is slidable forwardly to uncover the ventilation apertures 837. The forward movement of the forward section 833*b* is limited by a forward stop section 839 fixed to an exterior surface of the tobacco unit. The rearward section 833*a* and stop section 839 define a restraining means arranged such that the sleeve 833*b* can move between a first position covering the ventilation apertures 837, and a second position in which the ventilation apertures 837 are not covered.

The forward stop section 839 is preferably one or more layers of flexible material, preferably paper, surrounding the first filter and/or tobacco rod. The stop section 839 has an exterior surface which is preferably flush with an exterior surface of the forward section 833*b* of the sleeve, and the rearward section 833*a* of the sleeve. Alternatively, the forward section 833*b* of the outer sleeve is permanently fixed in position, and the rearward section 833*a* is slidable rearwardly to uncover the ventilation apertures 837. The stop section 839 may be located rearwardly of the rearward section 833*a* to limit movement of the rearward section 833*a*. Alternatively, both the forward section 833*b* and rearward section 833*a* are slidable longitudinally. A forward stop section may be located forwardly of the forward section 833*b* to limit forward movement of the forward section 833*b*, and a rearward stop section may be located rearwardly of the rearward section 833*a* to limit rearward movement of the rearward section 833*a*.

The profiled edges of the forward and rearward sections of the sleeve are described as interlocking and sinuous. Alternatively, the profiled edges may have any interlocking or complementary shape, for example, triangular or semi-circular features. The profiled edges may be interlocking for only a part of the circumference. Alternatively, the profiled edges may not be interlocking, and for example, may define one or two straight circumferential edges. Alternatively or in addition, the facing edges of the forward section 833*b* and the stop section 839 may have profiled edges which are interlocking and/or complementary, as described above.

The filter may comprise a first filter and a second filter which are rigidly and co-axially attached to the rear of the tobacco rod. Alternatively, the smoking article 830 may comprise only a single filter, which may be a double-length filter.

The smoking article 830 is configured such that an initial ventilation state can be selected as a minimum ventilation state, a maximum ventilation state or an intermediate ventilation state between the maximum and minimum values, as described with respect to FIGS. 1 to 5.

FIGS. 29*a* and 29*b* show a cross-section of a first control surface and a second control surface as described in any of the embodiments above. The first control surface and a second control surface may be configured as an indexing surface or as a guide surface. The cross-sections are not shown to scale.

FIG. 29*a* shows an example of the first control surface 850, which is formed on an exterior surface of the tobacco unit. The first control surface may be formed on a tubular member formed of cellulose acetate or paper, or may be formed on the exterior of a filter, as described above. The first control surface 850 comprises a plurality of longitudinally extending grooves 854 separated by longitudinally extending ridges 852. The plurality of ridges 852 and grooves 854 may define a sinuous outer surface, which smoothly oscillates in radius. The ridge between adjacent depressions may have a curved profile with a substantially uniform radius of curvature. The ridge between adjacent depressions defines a single circumferential point of maximum resistance to movement of the engaging feature between the adjacent depressions. The first control surface 850 may form the first control surface of any of the embodiments described.

FIG. 29*b* shows an example of the second control surface 860, which is formed on an interior surface of the sleeve. The second control surface may be formed on a tubular member formed of cellulose acetate or paper, as described above. The second control surface 860 comprises a plurality of longitudinally extending grooves 864 separated by longitudinally extending ridges 862. The plurality of ridges 862 and grooves 864 may define a sinuous outer surface, which smoothly oscillates in radius. The ridge between adjacent depressions may have a curved profile with a substantially uniform radius of curvature. The ridge between adjacent depressions defines a single circumferential point of maximum resistance to movement of the engaging feature between the adjacent depressions. The second control surface 860 may form the second control surface of any of the embodiments described.

One or more of the embodiments above describe ventilation apertures formed in a sleeve and/or in the tobacco unit. The ventilation apertures are formed such that air can flow into the sleeve or tobacco unit. In particular, the tobacco unit may comprise one or more layers of paper wrap surrounding a filter or chamber. The one or more layers of paper wrap may comprise a plugwrap and/or other material surrounding a filter comprising filtration material, and/or tipping paper joining a filter to a tobacco rod. The ventilation aperture extends through the one or more layers of paper wrap and any other material, such that the air can flow to the air permeable filtration material or chamber. The material in which the ventilation apertures are formed is substantially impermeable to air flow, or has a predetermined permeability to provide a base level of ventilation.

The ventilation aperture(s) of any embodiment may be in the form of a cut aperture, air permeable material or an aperture covered with an air permeable material. References to a ventilation aperture are intended to mean an area which is air permeable. An air permeable area, however formed, is termed a ventilation area.

The smoking article of any embodiment may comprise an adsorbent additive. In particular, the adsorbent additive is located in a filter. In some embodiments, the filter may be a substrate, in particular a first filter section, connected with another substrate, in particular, a second filter section, by a central core. Preferably, the central core is of filtration material, and is integrally formed with the filtration material of the first and second filter sections. An example of such filter sections which are rotatable relative to each other is described with respect to FIGS. 10 to 12. The adsorbent additive may be located in both filter sections, or only in an upstream (forward) filter section, or only in a downstream (rearward) filter section. Alternatively, the adsorbent additive may be located in one or more separate filters. The filter section comprising adsorbent additive may be the only filter section in the smoking article, or may one or more of a plurality of filter sections.

The adsorbent additive is preferably carbon, for example, charcoal and in particular, activated carbon. Alternatively, the adsorbent additive may be a resin. The resin may be an ion exchange resin with a polyamine group as chelating ligand bonded onto a cross-linked polystyrene matrix, for example, Diaion® CR20. The adsorbent additive is preferably located only in a forward filter, such that smoke subsequently passes through a second rearward filter which does not contain an adsorbent additive.

The smoking article of any embodiment may comprise a pod, preferably located wholly in a forward filter. The pod is located centrally within the forward filter, and surrounded by filtration material. The pod extends substantially the same length as the first filter. The pod comprises permeable walls containing an adsorbent additive, preferably charcoal. The walls prevent the additive from moving through the smoking article, whilst allowing smoke into contact with the adsorbent additive. The pod has the advantage that the adsorbent additive can be located within a relatively short longitudinal length.

Alternatively, the adsorbent additive may be located in a cavity (not shown). The cavity may be between first and second filters. The adsorbent additive may be granules of carbon, preferably in the form of charcoal, or any suitable adsorbent additive.

Alternatively, the adsorbent additive may be distributed within the filtration material of a first filter. The adsorbent additive may be substantially uniformly distributed in the filtration material, preferably cellulose acetate tow. The adsorbent additive may be granules of carbon, or any suitable adsorbent additive.

Alternatively, the adsorbent additive may be located around a periphery of a first filter section. The adsorbent additive may be affixed to an inner surface of a wrapper of sheet material surrounding the filtration material. The adsorbent additive is preferably adhered to the inner surface with an adhesive. The wrapper is preferably a porous paper, e.g. plugwrap.

In some embodiments, the smoking article comprises a first filter section and a second filter section arranged downstream of the first filter section, wherein the adsorbent additive is located in or around the first filter section, and is not present in the second filter section. The first filter section may be in two parts, connected by a central core, as described above, optionally with a separate second filter section downstream. In other embodiments, the first filter section may be a single body of filtration material, optionally with a separate second filter section located downstream. The adsorbent additive may be located in or around the first filter section, and is not present in the second filter section.

The embodiments of smoking articles are described as not having a chamber, or free internal space, between the first part and second part. Alternatively, any of the embodiments may have a chamber of fixed longitudinal length between the first part and second, and in particular between filters of the first and second parts. The ventilation may varied by rotation between the first and second parts, and restraining means prevents relative longitudinal movement which changes the length of the chamber. Alternatively, ventilation may be varied by longitudinal movement of an outer sleeve around the tobacco unit. In this case, any chamber is within the tobacco unit, and the length is not affected by movement of the outer sleeve. Alternatively, the smoking article may be extendable, having a variable length chamber defined by the first and second parts. The control mechanism described in any embodiment may be modified to control longitudinal movement, preferably providing indexing between a plurality of longitudinal positions. In particular, the grooves and ridges described may extend circumferentially instead of longitudinally.

The ventilation apertures in the sleeve and/or tobacco unit may be formed by a laser. In particular, the laser may simultaneously generate aligned ventilation apertures in the sleeve and tobacco unit. Alternatively, the ventilation apertures may be formed as a slit by a mechanical cutting tool. Alternatively, the ventilation apertures may be formed as a cut-out area. Alternatively, the ventilation apertures may be formed by an air permeable material, which is either manufactured as a permeable material or made permeable by the addition of apertures or by processing. Alternatively, the smoking article may not have one or more ventilation areas which are selectively controllable by the relative position of the first and second parts. The relative position of the first and second parts may control a flavourant, a smoke modifying additive, a filtration property, or any other attribute of the smoking article.

Any feature of the control mechanism as described with respect to FIGS. 1 to 5 may be applicable to any other embodiment. The depressions forming part of the control mechanism have been described as grooves. Alternatively, the depression may have any shape to engage with a feature in the other of the first or second part. In particular, the depressions may be square or circular.

The ridge between adjacent depressions defines a single circumferential point of maximum resistance to movement of the engaging feature between the adjacent depressions. Alternatively, the ridge may be a land having a substantially constant radius over the circumferential distance between adjacent depressions. The depressions in the first or second part may be configured to engage with any shape of protrusion in the other of the first or second part.

Any of the features of any embodiment may be combined with any of the features of any other embodiment. In particular, any of the embodiments of smoking article may or may not have a filter section adjoining the cylinder of tobacco, and/or may not have a filter section at the mouthpiece end of the sleeve. In particular, the sleeve may not have a filter attached to it, and may define a recess at the mouthpiece end or may have an edge at the mouthpiece end which is aligned with a rear end of the first filter. The restraining means or limiting means of any embodiment may be used with any other embodiment, to prevent or control longitudinal and/or rotational movement of the first part relative to the second part, or any part moveable over another part. The ventilation in a particular longitudinal or rotational position may be as described, or may be applicable to a different position, for example, by varying the location of one or more ventilation apertures.

A reference to a filter may alternatively refer to two adjacent and co-axial filters. One or more of the filters may be formed of a single segment of filter material or a plurality of segments. A filter formed of a plurality of segments may comprise segments made of different materials or having different filtration properties. In particular, a filter may comprise a standard segment of cellulose acetate tow and a further segment of filtration material including charcoal. Alternatively, the filter may be a single segment incorporating charcoal.

The invention claimed is:

1. A smoking article, comprising:

a first part, a second part movable relative to the first part, wherein the first part and the second part are elongate units having a common longitudinal axis, and a control mechanism comprising a first control surface extending around at least a part of a circumference of one of the first part and second part; and a second control surface on the other of the first and second parts, wherein the second control surface is configured to engage with the first control surface to control relative movement between the first part and second part, wherein the first control surface comprises a plurality of depressions spaced around the at least part of said circumference, and a ridge between each pair of adjacent depressions of the plurality of depressions, wherein for a given pair of adjacent depressions, the ridge defines a single point on said circumference of maximum resistance to movement of the second control surface between the given pair of adjacent depressions, wherein the first part is rotatable relative to the second part about said common longitudinal axis, and wherein the control mechanism is an indexing mechanism configured to control relative rotation between the first part and second part to select one of a plurality of indexing positions.

2. The smoking article according to claim 1, wherein at least one of:

the first control surface comprises a continuous surface defining said plurality of depressions, wherein the depressions are spaced around the circumference; and said plurality of depressions are in the form of elongate grooves which extend substantially in a direction parallel to said common longitudinal axis, and adjacent grooves are separated by said ridge.

3. The smoking article according to claim 1, wherein at least one of:

a) the first control surface is formed on a tubular member affixed around a section of the first part, and b) the second control surface is formed on a tubular member affixed to an interior surface of the second part; wherein the one or each tubular member is formed from a sheet material which is shaped to define at least one of the first control surface and second control surface.

4. The smoking article according to claim 3, wherein the tubular member on which the first control surface is formed is overlying a filter.

5. The smoking article according to claim 3, wherein the sheet material is a strip of cellulose acetate.

6. The smoking article according to claim 1, wherein at least one of:

the first part comprises a source of smokable material, and the second part comprises a sleeve arranged around the first part.

7. The smoking article according to claim 1, wherein the first control surface is an outer surface of a filter section; and optionally the filter section comprises filtration material wrapped with at least one sheet of material, wherein the at least one sheet is shaped to one of define and support the first control surface.

8. The smoking article according to claim 1, wherein at least one of the first control surface and second control surface has an outer surface coated in a film wrap formed of a plastics material.

9. The smoking article according to claim 8, wherein the film wrap is formed of a polymer material.

10. The smoking article according to claim 1, wherein the smoking article comprises a restraining means configured to limit relative movement between the first and second parts parallel to said common longitudinal axis, and wherein the restraining means comprises a first engaging surface on the first part engagable with a second engaging surface on the second part, and wherein the first part has a diameter, and the restraining means further comprises at least one of:

the first engaging surface, formed on a section of increased diameter with respect to the diameter of the first part;

the second engaging surface, formed within an outer surface of the second part; and the restraining means further comprising an end of the second part engagable with a third engaging surface formed on the first part.

11. The smoking article according to claim 1, wherein at least one first ventilation area is formed in the first part and at least one second ventilation area is formed in the second part, a said first ventilation area in the first part being uncovered when aligned with a said second ventilation area in the second part;

wherein the at least one second ventilation area of the second part overlies the first control surface; and wherein the first control surface comprises at least one groove extending at least partially in the longitudinal direction of the common longitudinal axis and having a longitudinal end, and wherein the at least one first ventilation area is located at the longitudinal end of the at least one groove of the first control surface, such that air can flow along the at least one groove having a first ventilation area and provide ventilation when the at least one groove is aligned with a second ventilation area.

12. The smoking article according to claim 1, including a filter comprising an adsorbent additive, wherein the absorbent additive is one of:

in a pod surrounded by filtration material, distributed within filtration material, in a cavity at least partially defined by filtration material, and one of on and adjacent an inner surface of a wrapper of sheet material surrounding filtration material.

13. A method of manufacturing a smoking article, comprising:

providing a first part, providing a second part, and attaching the second part to the first part such that the second part is movable relative to the first part, wherein the first part and the second part are elongate units having a common longitudinal axis, and the first and second parts further comprising a control mechanism comprising a first control surface extending around at least a part of a circumference of on one of the first part and second part;

and a second control surface on the other of the first and second parts, wherein the second control surface is configured to engage with the first control surface to control relative movement between the first part and second part, wherein the first control surface comprises a plurality of depressions spaced around the at least part of said circumference, and a ridge between each pair of adjacent depressions of the plurality of depressions, wherein for a given pair of adjacent depressions, the ridge defines a single point on said circumference of maximum resistance to movement of the second control surface between the given pair of adjacent depressions, and wherein the first part is rotatable relative to the second part about said common longitudinal axis, and wherein the control mechanism is an indexing mechanism configured to control relative rotation between the first part and second part to select one of a plurality of indexing positions.

14. The method according to claim 13, further comprising at least one of:

a) forming a tubular member having the first control surface, and affixing the tubular member around a section of the first part; and b) forming a tubular member having the second control surface, and affixing the tubular member to an interior surface of the second part, and optionally forming one or each tubular member from a sheet material which is shaped to define at least one of the first control surface and second control surface; and deforming a blank of the sheet material prior to forming the sheet material into a tube.

15. The method according to claim 14, wherein the tubular member on which the first control surface is formed is overlying a filter.

16. The method according to claim 14, wherein the sheet material is cellulose acetate.

17. The method according to claim 14, wherein the sheet material is deformed by one or more rollers to form at least one of the first control surface and the second control surface.

18. The method according to claim 13, further comprising forming a filter section having an outer surface comprising the first control surface, wherein forming the filter section comprises wrapping filtration material with at least one sheet of material, wherein the at least one sheet of material is shaped with depressions to one of define and support the first control surface.

19. The method according to claim 13, further comprising one of:

forming ventilation apertures in the first and second parts simultaneously such that an initial ventilation state is a maximum ventilation state; and forming ventilation apertures in the first and second parts separately, and prior to attaching the first and second parts, such that an initial ventilation state is one of a minimum ventilation state, and an intermediate ventilation state between the maximum and minimum values.

* * * * *